US011549696B2

(12) United States Patent
Schaefer et al.

(10) Patent No.: US 11,549,696 B2
(45) Date of Patent: Jan. 10, 2023

(54) DEHUMIDIFICATION SYSTEM WITH VARIABLE CAPACITY

(71) Applicant: Coil Research, LLC, Sparta, MI (US)

(72) Inventors: James C. Schaefer, Rockford, MI (US); Michael C. Laraway, Grand Rapids, MI (US); Thomas L. Cooper, Kent City, MI (US); Nicholas R. Hankamp, Sparta, MI (US)

(73) Assignee: Coil Research, LLC, Sparta, MI (US)

( * ) Notice: Subject to any disclaimer, the term of this patent is extended or adjusted under 35 U.S.C. 154(b) by 33 days.

(21) Appl. No.: 17/111,971

(22) Filed: Dec. 4, 2020

(65) Prior Publication Data

US 2022/0178559 A1 Jun. 9, 2022

(51) Int. Cl.
*F24F 3/14* (2006.01)

(52) U.S. Cl.
CPC .... *F24F 3/1405* (2013.01); *F24F 2003/1452* (2013.01)

(58) Field of Classification Search
CPC ..... F24F 11/84; F24F 11/85; F24F 3/1405; F24F 2100/20; F24F 2110/20
See application file for complete search history.

(56) References Cited

U.S. PATENT DOCUMENTS 5,121,613 A * 6/1992 Cox ..... F24F 1/0087 62/515

FOREIGN PATENT DOCUMENTS

EP 2963353 A1 * 1/2016 ..... F24F 3/153

* cited by examiner

*Primary Examiner* — Ana M Vazquez
(74) *Attorney, Agent, or Firm* — Warner Norcross + Judd LLP

(57) ABSTRACT

A multi-use system for influencing organic matter in an environmentally controlled room is provided with a modular dehumidification system. The modular dehumidification system includes a head unit, with separate cooling and heating subcircuits, and multiple modular dehumidifier units. Each modular dehumidifier unit has a cooling coil operable to cool and/or dehumidify the air and a heating coil operable to heat the air, for example, to raise room temperature and/or offset heat loss arising during dehumidification. The cooling coils are connected to the head unit in parallel to one another and the heating coils are connected to the head unit in parallel to one another. The number of modular dehumidifier units installed in the system is selected to provide the system with the desired maximum capacity. The control system may be configured to activate the appropriate number of cooling and heating coils, and to control the operation of each active coil.

21 Claims, 6 Drawing Sheets

DEHUMIDIFICATION SYSTEM WITH VARIABLE CAPACITY

FIELD OF THE INVENTION

The present invention relates to dehumidification systems for organic material, for example, in drying, curing, dehydration and storage of harvested plant matter and agricultural products.

BACKGROUND OF THE INVENTION

Environmentally Controlled (EC) rooms are commonly used to store fruits, vegetables, and other commodities that benefit from storage in environments where certain factors, such as temperature and atmospheric composition, can be controlled to extend the life of such items. EC rooms typically utilize systems for monitoring atmospheric conditions inside of a gastight space (e.g. temperature, gas levels, humidity, etc.), as well as systems for controlling such conditions to maintain the atmosphere at one or more desired set points. For example, EC rooms typically employ various heating, ventilation, and air conditioning (HVAC) components, such as heaters, blowers and fans, humidifiers, dehumidifiers, etc.

In addition to use as storage spaces, EC rooms can also be used in the preparation of certain agricultural products. For example, EC rooms in the form of greenhouses are used to germinate and cultivate many different varieties of plants, especially those not suitable for growth in a normal climate. Such specialized EC rooms are often used to maintain a compact growing area, preserve natural resources, minimize human resources, decrease crop loss from climate fluctuations and/or disease, etc. As another example, EC rooms are also used as dry rooms to prepare various cured products. Conventional dry rooms are generally configured to control room temperature (e.g. dry bulb) and relative humidity (i.e., the ratio of water vapor partial pressure ($P_w$) to equilibrium vapor pressure of water ($P^*_w$) at a given temperature (e.g. % RH=100($P_w/P^*_w$)) via use a simple on/off humidistat or dry bulb thermostat to control the operation of a cooling coil. However, the cooling coil cycling on and off in this configuration results in swings of the dew point in the room and wastes energy via reheat (i.e., simultaneously cooling and heating the air in the room). Moreover, as $P_w$ is dependent on dew point, $P^*_w$ is dependent on dry bulb temperature, and the vapor pressure of any given dryable/curable product is unique, these dry rooms are typically not suitable for use with widely-varying products or changing atmospheric conditions. For example, in the curing of certain plant products and foodstuffs (e.g. meats, cheeses, etc.), the rate of moisture loss is important due to the drying process requiring the loss of free water from within the product. If available water is removed from such a product too rapidly (e.g. from vapor pressure in the dry room being too low compared to a vapor pressure within the product), the outer layer of the product may become too dry, in turn reducing the rate at which moisture can leave the center of the product, or trapping moisture in the center of the product all together. As such, EC rooms provide a benefit over traditional dry rooms in terms of the selective atmospheric control offered, which allows for increased control in balancing the product vapor pressure and room vapor pressure and, ultimately, the rate at which moisture may be removed from a product.

Unfortunately, conventional EC rooms are limited in application due to constraints on the ranges of conditions that may be employed. In particular, the various HVAC and other components (e.g. heat pump dryers) employed in EC rooms, while often very effective when operated individually within a preferred range of conditions (e.g. within a particular temperature range, humidity range, etc.), are typically inefficient when operated outside of the preferred range. Moreover, these same components are frequently counter-productive when employed simultaneously. As such, conventional EC rooms are typically designed for but one, or at most a very limited number of applications, and rely on atmospheric control systems tailored toward efficient operation within narrow conditions necessary for such application.

For example, EC rooms often include dehumidifiers or air conditioners in order to control and maintain the humidity within a set range. However, as these components are typically heat pump systems utilizing refrigeration, the desired operating temperature range of the EC room must be carefully selected to ensure that the system provides adequate refrigeration capacity (e.g. to cover both latent and sensible heat duties), and optimum efficiency, while also maintaining the refrigerant in the correct phase (e.g. gaseous or liquid). Moreover, as the refrigeration capacity of the heat pumps are typically selected based on the size and maximum product loading of a given drying chamber, these systems are often both incapable of being scaled down for operations with a reduced-loading size (e.g. to maintain cost/load, reduce pump strain, etc.), and unable to accommodate scale-up (e.g. for increased drying capacity) without partial, or sometimes complete, replacement of refrigerating components. Moreover, conventional refrigeration systems are limited in terms of the RH ranges that may be realized during operation, thus placing constraints on both atmospheric temperature and moisture loads within the EC room. For example, operating below certain humidity levels (e.g. 45% RH) can require the use of a low coil temperature (e.g. <0° C.), which can lead to the formation of ice on the coils, reduced moisture removal capacity, etc., and necessitate the use of remedial procedures/components (e.g. defrost cycles, tandem coils, brine solutions etc.), which are often burdensome and expensive, to maintain proper function.

Owing to the challenges facing modern production and processing facilities, development of new technologies is needed to increase the capability, applicability, and flexibility of EC rooms and systems, while decreasing the costs and labor burdens associated with operating conventional EC rooms.

SUMMARY OF THE INVENTION

A dehumidification system for plant matter and other agricultural products in an environmentally controlled room is provided with a head unit and one or more modular dehumidifier units. Each modular dehumidifier unit may include a coil set with a cooling and a heating coil. The use of modular coil sets permits the dehumidification system to be scaled by activating/deactivating individual coil sets. This allows the system to function at different capacities and to operate at high efficiency at each of the different capacities. The dehumidification system includes a cooling refrigerant circuit that moves cooled refrigerant through the cooling coils to cool the air and/or dehumidify the air through condensation and a heating refrigerant circuit that moves heated refrigerant through the heating coils to heat the air, for example, to return heat energy to offset the heat loss in dehumidification or to heat the room. The modular coil sets are connected to the head unit so that the cooling coils of different coil sets are arranged in parallel with one another and the heating coils of different coil sets are arranged in parallel with one another. The number of modular coil sets installed in a system can be selected to provide the system with the desired maximum capacity, and the capacity of the system at any given time can be established by activating the appropriate number of coils or coil sets.

In one embodiment, the dehumidification system includes a control system capable of operating the system at different capacity levels by varying the number of active modular coil sets to achieve the desired level of dehumidification and operating each active coil within optimized parameters. For example, the flow rates and, in some cases, the refrigerant temperatures for the cooling refrigerant circuit and heating refrigerant circuit can be selected to provide optimized efficiency for the active cooling and heating coils. The use of modular coils arranged in parallel helps to provide enhanced refrigerant/coil performance and can result in reduced back-pressure.

In one embodiment, the head unit includes a cooling refrigerant subcircuit that cools the refrigerant and is capable of circulating the cooled refrigerant through the active cooling coils of the modular coil sets and a heating refrigerant subcircuit that heats the heated refrigerant and circulates heated refrigerant through the active heating coils of the modular coil sets.

In one embodiment, the cooling refrigerant subcircuit in the head unit includes a chiller (e.g. a glycol chiller) for cooling the refrigerant to the desired temperature, a pump for moving the cooled refrigerant through the cooling refrigerant circuit at the desired flow rate, a main refrigerant supply line for supplying the cooled refrigerant to the cooling coil(s) and a main refrigerant return line for returning refrigerant from the cooling coil(s). The cooling refrigerant subcircuit may also include a refrigerant reservoir and other desired accessories. The temperature and flow rate of the cooling refrigerant may vary from application to application, and may vary from time to time within a given application. In one embodiment, the refrigerant is a liquid refrigerant, such as a glycol-based or brine-based liquid coolant, that is intended to remain a liquid throughout operation and is not intended to undergo phase changes from a liquid to a gas during operation.

In one embodiment, the heating refrigerant subcircuit in the head unit includes a heater (e.g. a glycol heater) for heating the refrigerant to the desired temperature, a refrigerant pump for moving the heated refrigerant through the heating refrigerant circuit at the desired flow rate, a main refrigerant supply line for supplying the heated refrigerant to the heating coil(s) and a main refrigerant return line for refrigerant returning from the heating coil(s). The heating refrigerant subcircuit may also include a refrigerant reservoir and other desired accessories. The temperature and flow rate of the heating refrigerant may vary from application to application, and may vary from time to time within a given application.

In one embodiment, the cooling and heating refrigerant circuits are configured so that the modular coil sets are connected in parallel. For example, in one embodiment, each modular coil set includes supply and return line extensions for both the cooling and heating circuits. The supply and return line extensions of the first modular coil set can be connected directly to the main refrigerant supply and return lines, and each subsequent modular coil set can be connected directly to the supply and return line extensions of the preceding modular coil set. In one embodiment, the cooling coil is connected between the supply line extension for the cooling refrigerant supply line and the return line extension for the cooling refrigerant return line. Similarly, in one embodiment, the heating coil is connected between the supply line extension for the heating refrigerant supply line and the return line extension for the heating refrigerant return line.

In one embodiment, each modular coil set includes a first control valve that can be closed to selectively prevent the flow of refrigerant through the cooling coil, while still allowing the cooled refrigerant to flow to or from any subsequent modular coil sets. Similarly, each modular coil set may include a second control valve that can be closed to selectively prevent the flow of refrigerant through the heating coil, while still allowing the heated refrigerant to flow to or from any subsequent modular coil sets.

In one embodiment, the dehumidification system includes at least one integrated coil set with associated cooling and heating refrigerant circuits configured to allow any number of additional modular coil sets to be connected to the integrated coil set(s). In another embodiment, the dehumidification system does not include an integrated coil set, but instead, all of the coil sets are added to the system through the installation of modular coil sets. In both embodiments, the modular coil sets may be connected so that the cooling coils are arranged in parallel with one another and the heating coils are arranged parallel with one another. Two or more dehumidifier units can be removably coupled to each other for enclosed spaces of varying sizes, optionally for the storage of cannabis and other products.

In one embodiment, the control system may implement a control loop or a number of control loops to maintain coordinated and active control of the cooling refrigerant circuit and heating refrigerant circuit to meet the desired temperature and humidity set points, which may vary depending on the activity (e.g. controlled storage, drying, curing, dehydration, etc.) and the agricultural product involved (e.g. leaf plants, such as tobacco and cannabis, vegetables, fruits). For example, the flow rate and/or temperature of the heated refrigerant and the flow rate and/or temperature of the cooled refrigerant may be actively controlled to provide optimal performance in each of the active modular coil sets. The control system may include one or more temperature and humidity sensors. For example, temperature and humidity sensors may be arranged to separately measure the temperature and humidity of air in the room, air entering the dehumidification system, air between the coils, and air leaving the dehumidification system. Refrigerant temperature sensors may also be provided in some applications, for example, in applications in which the control system 40 will adjust refrigerant temperature through active control of the chiller and heater.

In one embodiment, each modular coil set is packaged within a modular dehumidifier unit having a housing with a blower and a condensation tray. The modular dehumidifier units are arranged to function in parallel with each unit drawing air from the room, processing the air and returning it to the room. The blower is arranged to draw in air, move it first over the cooling coil to dehumidify the air by condensation, move it second over the heating coil to return heat energy to the air and then move the air back into the room. A condensation tray collects moisture from the cooling coil.

The dehumidification system of the present invention includes a head unit capable of receiving one or more modular coil sets, which allows the maximum capacity of the system to be easily varied by adding and removing modular coil sets. The number of modular coil sets installed in the system can be selected to provide the system with the desired maximum capacity, and the capacity if the system at any given point in time can be set by activating the appropriate number of coils or coil sets. The wide capacity range of the dehumidification system allows it to be used for a wide range of activities, such as drying, curing, dehydrating, maintaining humidity and other activities made available through control of temperature and/or humidity (e.g. for controlled storage applications). The use of separate cooling and heating circuits allows the system to vary the operating parameters of the cooling and heating stages separately, thereby providing a greater range of control over the system. The cooling and heating coils are arranged in parallel, which facilitates selective activation of individual coils, provides enhanced refrigerant and enhanced coil performance and results in reduced back-pressure in the refrigerant circuits. The use of modular dehumidification units facilitates installation as the modular units can be pre-assembled with the ability for simple field installation to an existing dehumidification system. Further, the use of pass-through supply and return line extensions in each modular dehumidification system allows the modular dehumidification units to be installed in sequence while still providing a parallel refrigerant circuit arrangement for the cooling coils and a parallel refrigerant circuit arrangement for the heating coils. In operation, the control system allows the capacity of the system to be adjusted by activating only the desired number of modular coils or coil sets while maintaining efficient operation at each of the different capacities. In particular, the flow of refrigerant to one or more modular units can be shut off while maintaining the flow of refrigerant to one or more other modular units. Because the system includes separate heating and cooling circuits, the system is capable of dehumidifying with or without heating or cooling, and also capable of heating or cooling without dehumidification.

The present invention provides significant improvements over conventional dehumidification systems that include one large coil (e.g. 25 tons coil), particularly in applications where moisture removal requirements vary materially over time. With conventional systems, the large coil generally needs to run at near full refrigerant coil flow to deal with the large amount of heat offset and to maintain sufficiently cool coil surfaces to remove any meaningful amount of moisture. If refrigerant flow through a large coil is materially reduced, the coil surface temperature will typically be too warm to remove any moisture. So, even when only a small amount of moisture removal is desired, a conventional system with a single large coil has to run at near full glycol flow rates. On the other hand, the present invention provides modular coils that can be selectively activated or deactivated to effectively vary coil capacity to match with the desired moisture removal level. This significantly reduces energy usage and assures that all activated coil surfaces can be fully utilized thru the whole range of room requirements.

These and other features and advantages of the present invention will become apparent from the following description of the invention, when viewed in accordance with the accompanying drawings and appended claims.

DETAILED DESCRIPTION OF THE CURRENT EMBODIMENT

Figure 1:
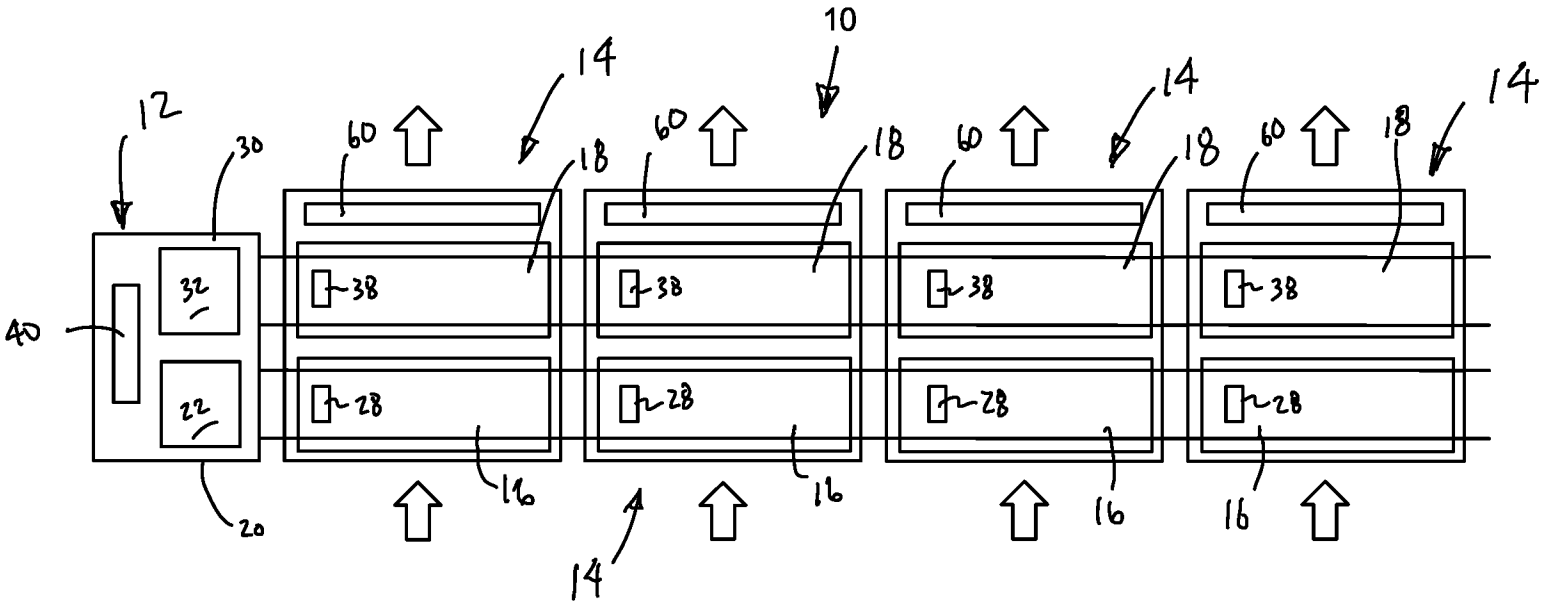
FIG. 1 is a schematic diagram of a drying system having a modular dehumidification system in accordance with an embodiment of the invention.

A dehumidification system in accordance with one embodiment is illustrated in FIG. 1 and generally designated 10. The dehumidification system 10 is configured for use with an environmentally controlled room and includes a cooling refrigerant circuit 20 that circulates cooled refrigerant through one or more modular cooling coils and a heating refrigerant circuit 30 that circulates heated refrigerant through one or more modular heating coils. The cooling refrigerant circuit 20 may be used to cool the air within the room and/or to dehumidifying the air through condensation. The heating refrigerant circuit 30 may be used to heat the air, for example, to offset the heat loss associated with dehumidification and/or to heat air within the room.

In the illustrated embodiment, the dehumidification system 10 includes a head unit 12 and a plurality of modular dehumidifier units 14. The head unit 12 includes a cooling refrigerant subcircuit 22 with a chiller 24 to cool a supply of refrigerant and a refrigerant pump 26 for circulating the cooled refrigerant through the remainder of the cooling refrigerant circuit 20, including the modular dehumidifier unit(s) 14. The head unit 12 also includes a heating refrigerant subcircuit 32 with a heater 34 to heat a supply of refrigerant and a refrigerant pump 36 for circulating the heated refrigerant through the remainder of the heating refrigerant circuit 30, including the modular dehumidifier unit(s) 14. Each modular dehumidifier unit 14 includes a modular coil set with a cooling coil 16 and heating coil 18. The head unit 12 and modular dehumidifier units 14 are configured so that the cooling coils 16 of different dehumidifier units 14 are connected to the cooling pump 26 in parallel and the heating coils 18 of different dehumidifier units 14 are connected to the heating pump 36 in parallel. The number of modular dehumidifier units 14 installed in the dehumidification system 10 can be selected to provide the desired maximum capacity. In the illustrated embodiment, each modular dehumidifier unit 14 includes one or more control valves 28, 38 that allow the coils of that particular dehumidifier unit 14 to be activated or deactivated without affecting operation of the remaining coils in the modular dehumidifier units 14. In operation, the number of active modular dehumidifier units 14 (or active coils) may be selected to provide the dehumidification system 10 with desired capacity, which may vary depending on the particular commodities and desired operation. Because the number of active modular dehumidifier units 14 (i.e. the number of active cooling coils and heating coils) can be varied to provide the appropriate capacity for any given operation, a control system 40, which is described in further detail below, is able to operate each active coil at or near its most efficient operating parameters regardless of the operation.

Figure 2:
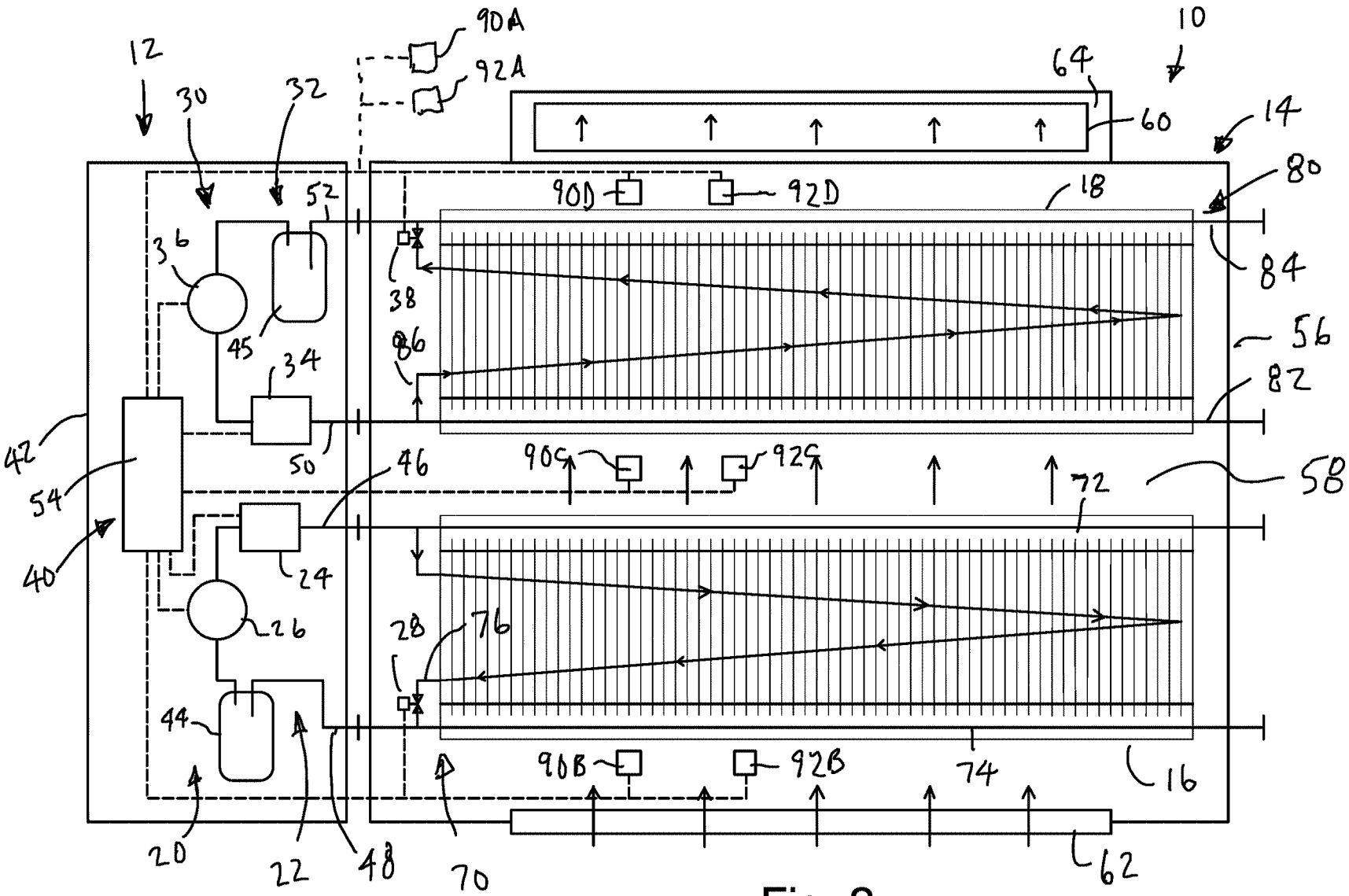
FIG. 2 is a schematic diagram of a modular dehumidification system with a single modular dehumidifier unit.

Referring now to FIG. 2, the head unit 12 of the illustrated embodiment includes a housing 42 that houses the cooling refrigerant subcircuit 22, the heating refrigerant subcircuit 32 and the control system 40. As noted above, the cooling refrigerant subcircuit 22 includes a chiller 24 to cool a supply of refrigerant. In this embodiment, the refrigerant is a mixture of a proprietary blend or appropriate mixture for the application (e.g. 30% propylene glycol and 70% water). The refrigerant may vary from application to application. For example, the concentration of propylene glycol may vary or a different refrigerant may be used. The chiller 24 may be essentially any glycol chiller capable of providing the desired cooling capacity. The chiller 24 for any given application may be selected based on the specifications of the refrigerant and the desired cooling capacity taking into consideration that the number of active modular dehumidifier units 14 may vary. In the illustrated embodiment, the chiller 24 may be a standard air or liquid cooled centralized process chiller system available from Frigadon or other various manufacturers. The cooled refrigerant is circulated through the cooling refrigerant circuit 20 by refrigerant pump 26. The refrigerant pump 26 may be any pump capable of circulating the cooled refrigerant through the cooling refrigerant circuit 20 at the range of flow rates desired taking into consideration that the number of active modular dehumidifier units 14 may vary. In operation, the refrigerant pump 26 may be operated to vary the flow rate based, at least in part, on the number of active modular dehumidifier units 14. In the illustrated embodiment, the refrigerant pump 26 is configured to operate based on refrigerant pressure, such as discharge pressure or differential pressure. In the illustrated embodiment, the refrigerant pump may be a centrifugal or multistage circulation pump available from Grundfos or other various vendors. In this embodiment, the cooling refrigerant subcircuit 22 also includes a refrigerant reservoir 44, such as an accumulator or receiver that is capable of maintaining the desired volume of surplus refrigerant.

To facilitate easy installation of modular dehumidifier units 14, the head unit 12 includes a first set of connection points for connecting a first dehumidifier unit 14 to the cooling refrigerant subcircuit 22 and a second set of connection points for connection the first dehumidifier unit 14 to the heating refrigerant subcircuit 32. More specifically, in the illustrated embodiment, the cooling refrigerant subcircuit 22 includes a main cooling supply line 46 that delivers the cooled refrigerant to the modular dehumidifier units 14 and a main cooling return line 48 that receives the cooled refrigerant returning from the modular dehumidifier units 14. In the illustrated embodiment, the main cooling supply line 46 includes a connection point with a fitting (e.g. sweated copper, threaded or quick-connect) intended to connect with the appropriate refrigerant line in a modular dehumidifier unit 14 and the main cooling return line 48 includes a connection point with a fitting (e.g. threaded or quick-connect) intended to connect with the appropriate refrigerant line in a modular dehumidifier unit 14.

In the illustrated embodiment, the heating refrigerant subcircuit 32 includes a heater 34 to heat a supply of refrigerant. In this embodiment, the refrigerant used in the heating refrigerant circuit 30 is a mixture of propylene glycol and water (e.g. 70% propylene glycol and 30% water). The refrigerant may vary from application to application. For example, the concentration of propylene glycol may vary or a different refrigerant may be used. The refrigerant type used in the heating and cooling circuits are the same in the illustrated embodiment, but they may differ from one another in other applications. The heater 34 may be essentially any glycol heater capable of providing the desired heating capacity. The heater 34 for any given application may be selected based on the specifications of the refrigerant and the desired heating capacity. In the illustrated embodiment, the heater 34 may be a SVF1100 available from Weil-Mclain. The heated refrigerant is circulated through the heating refrigerant circuit 30 by refrigerant pump 36. The refrigerant pump 36 may be any pump capable of circulating the heated refrigerant through the heating refrigerant circuit 30 at the desired range of flow rates taking into account the various capacity setting of the system 10. In operation, the refrigerant pump 36 may be operated to vary the flow rate based, at least in part, on the number of active modular dehumidifier units 14. In the illustrated embodiment, the refrigerant pump 36 is configured to operate based on refrigerant pressure, such as discharge pressure or differential pressure. In the illustrated embodiment, the refrigerant pump may be a CR64-1-1 available from Grundfos. In this embodiment, the heating refrigerant subcircuit 32 also includes a refrigerant reservoir 45, such as an accumulator or receiver that is capable of maintaining the desired volume of surplus refrigerant.

Similar to the cooling refrigerant subcircuit 22, the heating refrigerant subcircuit 32 of the illustrated embodiment includes a main heating supply line 50 that delivers the heated refrigerant to the modular dehumidifier units 14 and a main heating return line 52 that receives the heated refrigerant from the modular dehumidifier units 14. In the illustrated embodiment, the main heating supply line 50 includes a connection point with a fitting (e.g. threaded or quick-connect) intended to connect with the appropriate refrigerant line in a modular dehumidifier unit 14 and the main heating return line 52 includes a connection point with a fitting (e.g. threaded or quick-connect) intended to connect with the appropriate refrigerant line in a modular dehumidifier unit 14.

As noted above, the dehumidification system 10 includes a control system 40 that controls operation of the system through separate, but coordinated, control of the cooling refrigerant circuit 20 and the heating refrigerant circuit 30. The control system 40 may include a controller 54 that is capable of obtaining measurements from a plurality of sensors (such as temperature and humidity sensors that may be disposed at various points of interest) and controlling operating parameters. In FIG. 2, the control system 40 is shown with temperature sensors 90A-D and relative humidity sensors 92A-D, but the control system 40 may incorporate alternative sensor arrays selected to correspond with the implemented control scheme. In this embodiment, the controller 54 may control system operating parameters by controlling the flow rate of refrigerant through the various coils. This may be achieved by modulating control valves (as discussed in more detail below) or by controlling the flow rate of the refrigerant pumps 26, 36. In some applications, the controller 54 may also control operation of the speed of the blowers 60 (as discussed in more detail below), the output temperature of the chiller 24 and/or the output temperature of the heater 34. In this embodiment, the controller 54 is housed within the head unit 12 and the desired sensors may be located in essentially any location within the environmentally controlled room, the head unit 12 and the modular dehumidifier units 14. In alternative embodiments, the controller 54 may be located separately from the heat unit 12.

Figure 3:
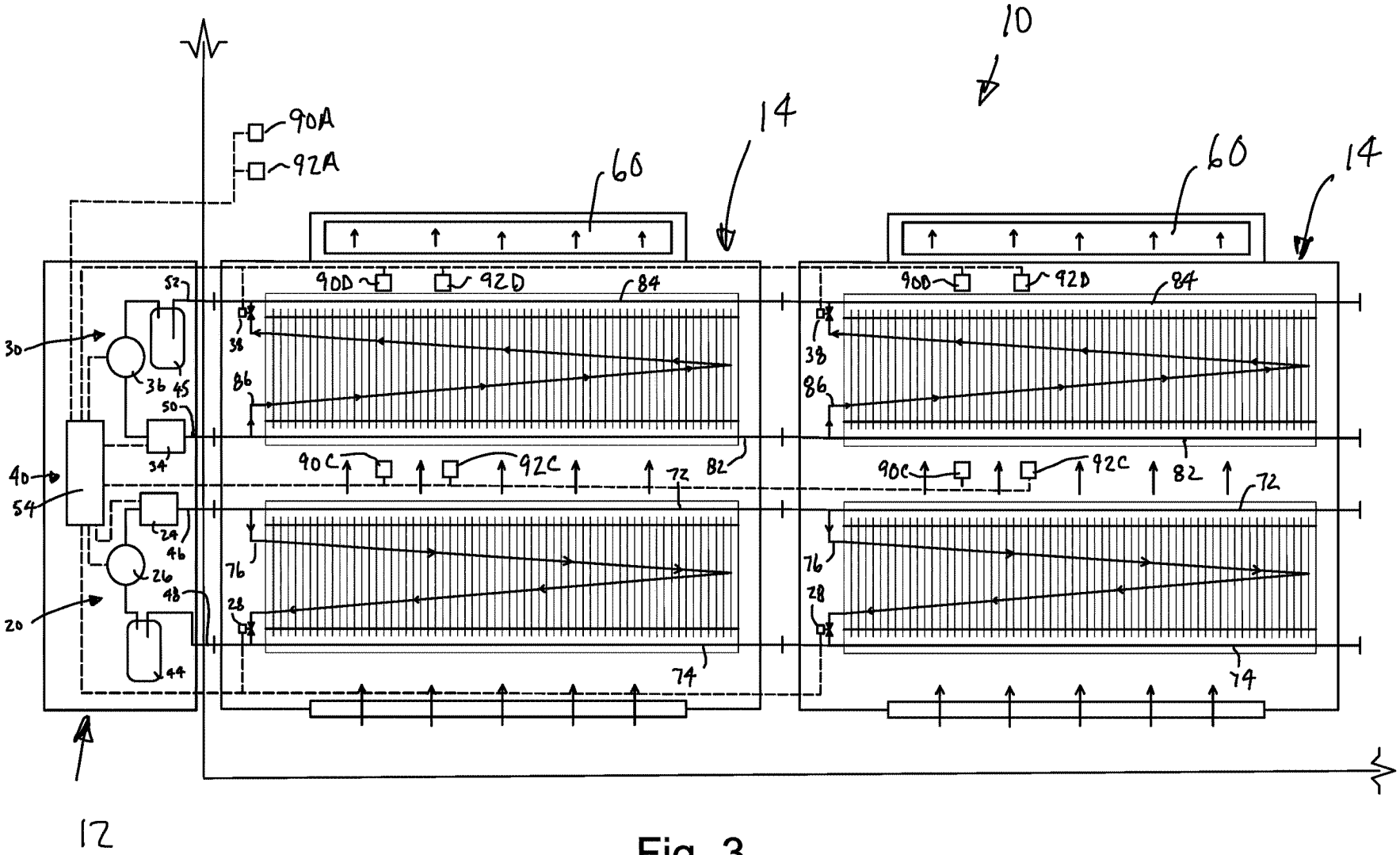
FIG. 3 is a schematic diagram of a modular dehumidification system with a pair of modular dehumidifier units connected in parallel in accordance with an embodiment of the invention.

As described above, the dehumidification system 10 includes one or more modular dehumidifier units 14 operatively connected to the head unit 12. In this embodiment, the first modular dehumidifier unit 14 is attached directly to the head unit 12 and each of the remaining dehumidifier units 14 are connected in sequence to the preceding modular dehumidifier unit 14. The number of installed modular dehumidifier units 14 establishes the maximum dehumidification capacity of the dehumidification system 10. For example, FIG. 1 shows one embodiment in which the dehumidifier system 10 includes four modular dehumidifier unit 14 connected to a head unit 12. As another example, FIG. 3 shows two modular dehumidifier units 14 connected to a head unit 12. When it is desirable for the dehumidification system 10 to operate at less than its maximum dehumidification capacity, one or more of the modular dehumidifier units 14 may be deactivated. For example, the dehumidification system 10 of FIG. 1 can be operated with one, two, three or four activate modular dehumidifier units 14, thereby selectively providing the dehumidification capacity available from one to four coil sets. As described in more detail below, the cooling refrigerant circuit 20 and the heating refrigerant circuit 30 are configured so that the cooled refrigerant flows through the cooling coils 16 of the various modular dehumidifier units 14 in parallel and the heated refrigerant flows through the heating coils 18 of the various modular dehumidifier units 14 in parallel. The parallel configuration improves the operating efficiency of the refrigerant and consequently the coils, and also facilitates selective deactivation of one or more of the modular dehumidifier units 14.

In the illustrated embodiment, each modular dehumidifier unit 14 generally includes a housing 56 that contains a modular coil set and a blower 60 for moving air over the modular coil set. The housing 56 includes an air inlet 62, an air outlet 64 and an internal chamber 58 disposed along an air flow path from the air inlet 62 to the air outlet 64. The blower 60 may be disposed in essentially any location within the housing 56, such as in the air inlet 62 or the air outlet 64. In some applications, the internal blower 60 may be replaced by an external blower. For example, in an alternative embodiment, an external blower may be provided to move air through a plurality of dehumidifier units 14. As noted above, the modular coil set includes a cooling coil 16 and a heating coil 18. In the illustrated embodiment, the cooling coil 16 and heating coil 18 are arranged in series in the internal chamber 58 in the sense that air moving along the air flow path passes first over the cooling coil 16 and then over the heating coil 18. In operation, the cooling coil 16 cools the air flowing through the internal chamber 58, and can be used to lower the room air temperature and/or to dehumidify the air. For example, if the air is cooled below the room air dew point, water vapor in the air will condense and collect in a condensation tray or other receptacle (not shown). If the air is cooled to a temperature above the dew point, the air will be cooled, but substantial condensation will not take place. The heating coil 18 supplies heat energy to the air. When the cooling coil 16 is operating to dehumidify the air, the heating coil 18 can be used to offset the heat loss occurring during dehumidification. It can also be used to raise the air temperature in the room even when dehumidification is not occurring.

In the illustrated embodiment, each coil 16, 18 is integrated into a heat exchanger with the coil penetrating a large number plates, for example rectangular aluminum fins that provide increased surface area and improved heat transfer (sometime referred to as a "fin-and-tube" construction). While the cooling coil 16 and the heating coil 18 are described as having a fin-and-tube construction, other constructions are possible in other embodiment, for example corrugated fin-type heat exchangers.

As noted above, the refrigerant circuits 20, 30 are arranged so that the cooling coils 16 operate in parallel with one another and the heating coils 18 operate in parallel with one another. To facilitate the parallel configuration, each modular dehumidifier unit 14 includes a cooling refrigerant subcircuit 70 configured to allow cooled refrigerant to flow through the cooling coil 16 and to flow to and return from any downstream modular dehumidifier units 14 and a heating refrigerant subcircuit 80 configured to allow heated refrigerant to flow through the heating coil 18 and to flow to and return from any downstream modular dehumidifier units 14. Referring now to FIGS. 2 and 3, the cooling refrigerant subcircuit 70 include a pass-through supply extension line 72 and a pass-through return extension line 74. The supply extension line 72 includes a first end that can be connected to a supply of cooled refrigerant, such as the main cooling supply line 46 or the second end of the supply extension line 72 of a preceding modular dehumidifier unit 14, and a second end that can be connected to a subsequent modular dehumidifier unit 14. The return extension line 74 includes a first end that can be connected to the main cooling return line 48 or the second end of the return extension line 74 of a preceding modular dehumidifier unit 14, and a second end that can be connected to a subsequent modular dehumidifier unit 14. The cooling coil 16 is disposed along a refrigerant path 76 connected between the supply extension line 72 and the return extension line 74. As noted above, each modular dehumidifier unit 14 may include a control valve 28 to allow the cooling coil 16 to be modulated and selectively deactivated. In the illustrated embodiment, the control valve 28 is disposed along the cooling coil refrigerant path 76. In this position, the control valve 28 can be opened and closed to allow or prevent the flow of cooled refrigerant through the cooling coil 16 without preventing cooled refrigerant from flowing through the cooling coil 16 of any other modular dehumidifier unit 14.

Referring again to FIGS. 2 and 3, the heating refrigerant subcircuit 80 includes a pass-through supply extension line 82 and a pass-through return extension line 84. The supply extension line 82 includes a first end that can be connected to a supply of heated refrigerant, such as the main heating supply line of the head unit 12 or the second end of the supply extension line 82 of a preceding modular dehumidifier unit 14. The supply extension line 82 also includes a second end that can be connected to a subsequent modular dehumidifier unit 14. The return extension line 84 includes a first end that can be connected to the main heating return line of the head unit 12 or the second end of the return extension line of a preceding modular dehumidifier unit 14. The supply extension line 82 also includes a second end that can be connected to a subsequent modular dehumidifier unit 14. The heating coil 16 is disposed along a refrigerant line 86 connected between the supply extension line 82 and the return extension line 84. As noted above, each modular dehumidifier unit 14 may include a control valve 38 to allow the cooling coil 16 to be modulated and selectively deactivated. In the illustrated embodiment, the control valve 38 is disposed along the heating coil refrigerant line 86. In this position, the control valve 38 can be opened and closed to allow or prevent the flow of heated refrigerant through the heating coil 18 without preventing heated refrigerant from flowing through the heating coil of any other modular dehumidifier unit 14.

Although the illustrated embodiment implements parallel coil connections through the use of pass-through refrigerant lines, the present invention may be implemented with alternative types of parallel connection for the cooling coils and/or the heating coils. For example, rather than connecting the coils in sequence, the cooling coils may connect to a common cooling coil manifold and the heating coils may connect to a common heating coil manifold.

In the various illustrated embodiments, the head unit 12 does not includes a coil set. Instead, each coil set is provided by installing a separate modular dehumidifier unit 14. However, in alternative applications, the dehumidification system 10 may be provided with one or more integrated coil sets permanently installed as an integral part of the cooling and heating refrigerant circuits, for example, as part of the head unit 12. Like the coil sets in the modular dehumidifier units 14, the integrated coil sets may be connected to the main supply lines and main return lines in parallel. Further, each integrated coil set may include control valves that allow the integrated cooling coil and the integrated heating coil to be controlled by the control system 40 in the same manner as coil sets within the dehumidifier units 14 as described in more detail below.

Control System.

As discussed above, the dehumidification system 10 of the illustrated embodiment includes a control system 40 that actively controls operation of the system 10. In the illustrated embodiment, the control system 40 is configured to provide automated control by monitoring the room conditions, and controlling operation of the cooling coils and the heating coils to drive the room to desired set points, such as temperature and humidity set points defined by an operator or by a control algorithm. The set points may vary depending on the content of the room and the desired operation, such as drying, curing, dehydrating, maintaining humidity and other temperature/humidity related operations. For example, in the context of curing, the control system 40 may move through a predetermined sequence of temperature and humidity settings to implement the desired process. With regard to system capacity, the control system 40 is generally configured to activate the appropriate number of cooling and heating coils, and to control the operation of each active coil. For example, the control system 40 may begin operation with one or more cooling coils and one or more heating coils, and subsequently activate or deactivate coils as needed to maintain efficient operation. In one embodiment, the control system 40 may begin operation with a predetermined number of active cooling coils and heating coils, and the control system 40 may run a control algorithm that increases or decreases the number of active cooling coils and heating coils in realtime, as needed move the room to the desired set points. In one embodiment, the control system 40 will activate additional coils if the rate of change in room conditions toward the applicable set points is not sufficient, and will deactivate coils as they are no longer needed (either because the set points have been reached or the system 10 is approaching the set points at too high of a rate of change). With regard to individual coil control, the control system 40 is generally configured to operate each active coil at or near optimized parameters. For example, the control system 40 may control the amount and/or temperature of the cooling refrigerant flowing through each cooling coil and the amount and/or temperature of the heating refrigerant flowing through each heating coil.

In the illustrated embodiment, for example, the control system 40 is capable of providing automated control by modulating the control valves 28, 38 in each of the modular dehumidifier units 14. Through modulation of the control valves 28, 38, the control system 40 is capable of not only activating and deactivating individual coils to vary system capacity, but also of controlling the flow rate of refrigerant through each individual active coil, thereby allowing for efficient operation of each active coil. For example, to operate the system 10 at maximum capacity, the control system 40 opens the control valves 28, 38 in all of the modular dehumidifier units 14. Alternatively, the control system 40 may operate the system 10 at reduced capacity by closing the control valves 28, 38 in one or more of the modular dehumidifier units 14, thereby deactivating the corresponding coil sets. In alternative embodiments, the control valves 28, 38 may be actuated manually rather than through automation.

In the illustrated embodiment, the control system 40 is configured to operate each of the active coils in the dehumidification system 10 at or near its optimized design parameters. For example, the control system 40 maybe configured to set the flow rate of cooled refrigerant through each active cooling coil to operate that particular cooling coil at or near optimized design parameters, and to set the flow rate of heated refrigerant through each active heating coil to operate that particular cooling coil at or near optimized design parameters. When the system determines that the active coils operating at or near optimized design parameters are not moving the room toward the desired room conditions at a sufficient rate, the system may activate an additional coil or coil set to increase the capacity. Conversely, when the room has reached the desired set points or is approaching the set points too quickly, the control system 40 may deactivate one or more coil sets to decrease capacity. During operation, the control system 40 may control operation of the control valves 28, 38 to maintain efficient operation based on sensed room parameters, such as temperature, humidity and/or dew point within the room, and/or temperature, humidity and/or dew points at various locations with the dehumidifier units 14. In some embodiments, the control system 40 may additionally or alternatively vary the temperatures of the cooled refrigerant and the heated refrigerant.

Operation of one embodiment of the present invention will now be described in more detail in the context of control system 40 illustrated schematically in FIG. 3. In this embodiment, the control system 40 is capable of operating in a dehumidification mode in which the room may be heated, cooled or the temperature maintained, and in a temperature control mode in which the room is cooled or heated without dehumidification. In this embodiment, the control system 40 is configured to operate the dehumidification system 10 to bring the room to a temperature set point and relative humidity set point specified by an operator. To implement this control scheme, the control system 40 includes a controller 54 (e.g. a PLC) that, among other things, modulates the cooling coil control valves 28 and the heating coil control valves 38 to separately control the flow rate of cooling refrigerant through the cooling coils and heating refrigerant through the heating coils. More specifically, the controller 54 operates to bring the room to temperature and relative humidity set points specified by the operator using readings obtained from a room temperature sensor 90A, a room relative humidity sensor 92A, a cooling coil temperature sensor 90C for each active cooling coil and a heating coil temperature sensor 90D for each active heating coil. It should be understood that this sensor array is merely exemplary and the control system 40 may control operation of the dehumidification system 10 based on a variety of different sensor arrays that differ from application to application. For example, in some alternative applications, the control system 40 may operate based on a single room temperature sensor and a single room humidity sensor. In other alternative embodiments, the control system 40 may operate based on air temperature sensors and humidity sensors disposed at various alternative locations within the system 10, such as in the main body of the room, at the entry to each modular humidifier unit 14, in the discharge of the cooling coil and/or in the discharge of the heating coil. In alternative embodiments, the control system 40 may also take into consideration refrigerant temperature in the cooling refrigerant circuit and/or the heating refrigerant circuit. For example, in some applications, the control system 40 may control operation, at least in part, based on refrigerant temperature gain across the active cooling coils and/or heating refrigerant temperature loss across the active heating coils.

As described in more detail below, the controller 54 automatically engages and disengages additional cooling coils and heating coils to vary the dehumidification and temperature control capacity of the system in realtime. Although the illustrated embodiment includes a single central controller (e.g. controller 54) that controls operation of the various control valves and blowers, the control system 40 may alternatively implement some form of distributed control. For example, in some applications, each modular dehumidifier unit 14 may include an onboard controller (not shown) capable of controlling operation of the various components of that unit. When used, each dehumidifier unit controller may be configured to obtaining readings from sensors associated with that unit, such as temperature and relative humidity, of modulating the control valves for the associated cooling and heating coils and of controlling operation of the blower for that unit. When a plurality of modular dehumidifier units 14 with onboard controllers are incorporated into a single room, one of those controllers may be configured as the master controller for that room. The room master controller may generally run the control loops for the room; receive sensor readings from the room sensors; receive sensor readings from its own sensors; receive sensor readings from other unit controllers in the room; operate its own control valves and blower; and send appropriate control valve and blower operating instructions to the other unit controllers in the room.

Referring again to embodiment of FIG. 3, the operator provides the control system 40 with operating parameters, including a temperature set point and relative humidity set point, for the room. In alternative embodiments, the operator may specify alternative set points that include one or more of temperature, relative humidity, absolute humidity and/or dew point set points for the room. In implementations that involve multiple rooms, the operator may provide different set points for different rooms, and the controller 54 may be configured to control operation of each room separately based on the set points for that room and the room temperature and room relative humidity measurements obtained from that room. Returning now to the illustrated embodiment, the controller 54 continuously monitors the room temperature and the room relative humidity, and compares them with the temperature set point and the relative humidity set point for that room. The controller 54 provides control of the cooling coil control valve 28 and the heating coil control valve 38 based on these comparisons. For example, if the room parameters deviate from either or both of the temperature and humidity set points by a predetermined threshold, the controller 54 will operate the control valves 28, 38 of the cooling and heating coils as needed to correct the discrepancy and to maintain room temperature and room relative humidity at the specified set points.

The control system 40 may employ any of a wide range of control algorithms for implementing this functionality, including, for example, generally conventional PID algorithms or generally conventional "Ramp and Soak" algorithms. In the illustrated embodiment, the control system 40 implements a plurality of PID control loops that use realtime feedback to provide continuously modulated control of the cooling coil control valves 28 and the heating coil control valves 38. More specifically, the control system 40 implements nested PID loops with an outer control loop that commences operation and controls system capacity (the "main control loop") and inner control loops that operate the active coils at the appropriate operating parameters (the "coil control loop"). In this implementation, the PID control loops are generally conventional PID control loops that continuously calculate an error value that represents the difference between a desired set point (SP) and a measured process variable (PV) and provides an output based on proportional, integral, and derivative terms (denoted P, I, and D respectively). The set point and the process variable vary depending on the mode of operation, as discussed in more detail below.

In the illustrated embodiment, the main control loop continuously monitors the room temperature and room relative humidity readings obtained from the room temperature sensor 90A and the room relative humidity sensor 92A, and compares them with temperature and humidity set points for the room. The set points may be input by an operator or may follow an algorithm stored in memory to implement the desired operation, such as drying, curing, dehydrating, etc. While the room temperature and room humidity remain within desired thresholds of the room temperature and humidity set points, the system remains in an idle mode in which all of the coils are inactive. While the system is in the idle mode, the blower(s) 60 may be off, operate continuously, operate periodically or operate at a reduced flow rate, as desired. For example, it may be desirable to run one or more of the blowers 60 at least occasionally to provide air circulation and promote air uniformity within the room.

When the main control loop determines that room temperature and/or room relative humidity differ from the corresponding room set point by a predetermined amount, the main control loop transitions operation of the dehumidification system 10 from the idle mode into the appropriate mode of operation. In this embodiment, the control system 40 is capable of operating in an idle mode (no active coils), a temperature control mode (heating or cooling, but no dehumidification) and dehumidification mode (with heating, cooling or temperature maintenance). As described in more detail below, the control system 40 determines the appropriate mode of operation based on whether the temperature and/or the relative humidity has varied from the set points and on the direction of the variance.

When the control system 40 determines that the relative humidity in the room has exceeded the relative humidity set point by the applicable threshold, the main control loop transitions the system 40 into the dehumidification mode. The main control loop begins by determining system capacity based on a PID algorithm in which the PID set point (SP) is the room relative humidity set point and the PID present value (PV) is the room relative humidity measurement taken in realtime from the room relative humidity sensor 92B. In this embodiment, the main control loop in configured to provide a scaled output that is used to determine the number of modular dehumidifier units 14 to activate. For example, the output of the main control loop may be an output value in the range of 1-N (or N+0.99), where N is the number of modular dehumidifier units 14 in the room, and the control system 40 activates the number of modular dehumidifier units 14 represented in the ones digit of the output value. To illustrate, in a room having four dehumidifier units 14 (and consequently four coil sets), the main control loop may be scaled to provide an output value in the range of 1.00 to 4.99. In this illustration, a single coil set is activated when the output value is in the range of 1.00-1.99, two coil sets are activated when the output value is in the range of 2.00-2.99, three coil sets are activated when the output value is in the range of 3.00-3.99 and four coil sets are activated when the output value is in the range of 4.00-4.99. The characteristics of operation of the main control loop can be varied by adjusting the various parameters within the PID algorithm using conventional methodologies. In alternative applications, the number of starting active coil sets can be determine based on historical data. For example, each time the system operates in a dehumidification or temperature control mode, the system may store historical data representing the initial temperature and humidity deviations of the room and the number of coil sets eventually activated to address those deviations. In operation, the control system 40 may look to the historical data rather than the main control loop output value to determine the number of coil sets to initially activate when the system transitions from the idle mode into a dehumidification or temperature control mode. When this or similar data is maintained, the control system may review the historical data for instances of similar temperature and humidity deviations, and then activate the number of coil sets eventually engaged when the system previously operated under similar deviations.

Once the number of active coil sets are determined by the main control loop, a separate coil control loop is established for each active coil to control operation of that coil over time. At the same time, the main control loop will continue to operate in the background and will activate or deactivate coil sets to maintain operation of the system at the appropriate capacity throughout operation, and to eventually return the system to the idle mode when the desired room set points have been achieved. In this implementation, each coil control loop continuously calculates an error value that represents the difference between a desired set point (SP) and a measured process variable (PV) for that coil and applies a correction to the control valve setting for that coil based on proportional, integral, and derivative terms. The set point and the process variable vary depending on the mode of operation as will be described in more detail below. In this embodiment, the coil control loop provides proportional control of the control valves, but in alternative applications running different control algorithms, the control valves may be subjected to on/off control.

Returning again to the situation where the control system 40 has determined that the room relative humidity exceeds the relative humidity set point by more than a specified threshold, such as two percent, and the room has entered into dehumidification mode to reduce the humidity in the room and bring it back into line with the relative humidity set point. In this mode, the control system 40 will employ a first PID coil control loop that modulates the cooling coil control valve 28 to maintain the temperature of the air discharging from the cooling coil 16 at a temperature control set point and will employ a second PID coil control loop that modulates the heating coil control valve 38 to maintain the temperature of the air discharged from the heating coil 18 at the temperature set point. The process variable for the cooling coil PID control loop is the temperature of the air discharged from the cooling coil as measured by the cooling coil temperature sensor 90C. The set point for the cooling coil PID control loop may vary from application to application, but will generally be at or below the room dew point to ensure that dehumidification will occur. For example, the set point for the cooling coil PID control loop may be in the range of 0 to 10 degrees below the dew point. In this embodiment, the room dew point is continuously or periodically determined based on then-current room temperature from sensor 90A and then-current room relative humidity readings from sensor 92A. The process variable for the heating coil PID control loop is the temperature of the air discharged from the heating coil as measured by the heating coil temperature sensor 90C. The set point for the heating coil PID control loop is the temperature set point entered by the operator. So, in this mode, the control valve 28 for each active cooling coil will be modulated by the corresponding cooling coil control loop to maintain that cooling coil in a state of dehumidification even as the dew point within the room might vary, and the control valve 38 for each active heating coil will be modulated by the corresponding heating coil control loop to cause the temperature exiting that dehumidifier unit 14 to correspond with the room temperature set point.

In situations where the room is in dehumidification mode and the actual room temperature as measured by sensor 90A has varied more than a predetermined threshold from the room temperature set point, the heating coil PID control loop may be varied somewhat to help move the room back to the desired temperature (i.e. room temperature set point). For example, in the illustrated embodiment, the set point of the heating coil control loop may be set to an alternate value when it is desirable to raise or lower the room temperature (and not merely offset the temperature loss caused by the cooling coil). More specifically, when the room temperature has fallen below the room temperature set point by more than the predetermined threshold (e.g. two degrees), the set point for the PID heating control loop may be X degrees above the set point, where X may be in the range of 0 to 20 degrees, or in the range of 5 to 10, or some other range as may be desired. Similarly, when the room temperature has risen above the room temperature set point by more than a predetermined threshold (e.g. two degrees), the set point for the PID heating control loop may be X degrees below the set point, where X may be in the range of 0 to 20 degrees, or in the range of 5 to 10, or some other range as may be desired.

When the control system 40 is operating in the idle mode and it determined by sensor 92A that the relative humidity in the room is within the desired threshold, but the room temperature as measured by sensor 90A exceeds the room temperature set point by the applicable threshold, the main control loop transitions the system 40 into the cooling mode (without dehumidification). In this embodiment, the main control loop determines system capacity based on a PID algorithm in which the PID set point (SP) is the room temperature set point and the PID present value (PV) is the room temperature measurement taken in realtime from the room temperature sensor 90A. In this embodiment, the main control loop in configured to provide a scaled output that is used to determine the number of cooling coils to activate. As discussed above in connection with the discussion of dehumidification mode, the output of the main control loop may be an output value in the range of 1-N (or N+0.99), where N is the number of cooling coils in the room, and the control system 40 activates the number of cooling coils represented in the ones digit of the output value (e.g. one cooling coil for 1.00-1.99, two cooling coils for 2.00-2.99, three cooling coils for 3.00-3.99, and so on). The characteristics of operation of the main control loop can be varied by adjusting the various parameters within the PID algorithm using conventional methodologies. As with dehumidification mode, the number of starting active cooling coils can, in some applications be determine based on historical data as discussed above.

Once the main control loop has determined the number of active cooling coils, a separate coil control loop is established for each active cooling coil to control operation of that cooling coil over time. In this embodiment, the main control loop continues to operate in the background and activates or deactivates cooling coils to maintain operation of the system at the desired capacity throughout operation, and to eventually return the system to the idle mode when the desired room temperature has been achieved. In this implementation, the coil control loop for each active cooling coil employs implements a PID algorithm that modulates the cooling coil control valve 28 to maintain the temperature of the air discharging from the cooling coil at a control set point that is above the dew point for the room, which allows cooling without dehumidification. The value of this temperature control set point may vary from application to application, but will be above the room dew point and at or below the temperature set point. For example, the control set point may be 1 to 5 degrees above the current dew point, or 3 to 8 degrees below the current room temperature. When the control set point is not based on dew point, the control system 40 may implement a lower temperature limit that is based on current dew point to ensure that the cooling coil remains above the dew point and does not cause appreciable dehumidification. For example, the control system 40 may maintain a lower temperature limit that is 5 or 10 degrees above the then-current room dew point. In operation, the control system 40 may continuously or periodically recalculate the dew point based on then-current temperature and relative humidity measurements for the room. In some applications, it may be desirable for the temperature control set point to vary as a function of the difference between the room temperature and room temperature set point, such as a fraction or multiple of the difference. In this embodiment, the cooling coil control loop provides proportional control of the cooling control valves, but in alternative applications, the cooling control valves may be subject to on/off control.

While operating in the cooling mode (without dehumidification), the control system 40 will continue to monitor room temperature and room relative humidity and may transition the room into an alternative mode as appropriate, such as the idle mode if the room temperature and the room relative humidity come within the specified thresholds from the applicable set points or into a dehumidification mode if the room relative humidity exceeds the relative humidity set point by more than the applicable threshold.

When the control system 40 is operating in the idle mode and it determines that the relative humidity in the room is within the desired threshold, but the room temperature has fallen below the room temperature set point by the applicable threshold, such as two degrees, the main control loop transitions the system 40 into the heating mode (without dehumidification). In this embodiment, the main control loop determines system capacity based on a PID algorithm in which the PID set point (SP) is the room temperature set point and the PID present value (PV) is the room temperature measurement taken in realtime from the room temperature sensor 90A. In this embodiment, the main control loop in configured to provide a scaled output that is used to determine the number of modular dehumidifier units 14 to activate. As discussed above in connection with the discussion of dehumidification mode, the output of the main control loop may be an output value in the range of 1-N (or N+0.99), where N is the number of heating coils in the room, and the control system 40 activates the number of heating coils represented in the ones digit of the output value (e.g. one heating coil for 1.00-1.99, two heating coils for 2.00-2.99, three heating coils for 3.00-3.99, and so on). The characteristics of operation of the main control loop can be varied by adjusting the various parameters within the PID algorithm using conventional methodologies. As with dehumidification mode, the number of starting active heating coils can, in some applications be determine based on historical data as discussed above.

Once the main control loop has determined the number of active heating coils, a separate coil control loop is established for each active heating coil to control operation of that heating coil over time. In this embodiment, the main control loop continues to operate in the background and activates or deactivates heating coils to maintain the desired capacity as parameters within the room vary over time, and to eventually return the system to the idle mode when the desired room temperature has been achieved. In the heating mode, the control system 40 will employ a PID control loop that modulates the heating coil control valve 38 to maintain the temperature of the air discharging from the heating coil at a control set point. The value of this temperature control set point may vary from application to application, but will be at or above the room temperature set point. For example, the control set point may be in the range of 5 to 30 degrees above the room temperature set point or in the range of 10 to 20 degrees above the room temperature set point. While operating in the heating mode, the control system 40 will continue to monitor room temperature and room relative humidity and may transition the room into an alternative mode as appropriate, such as the idle mode if the room temperature and the room relative humidity come within the specified thresholds from the applicable set points or into a dehumidification mode if the room relative humidity exceeds the relative humidity set point by more than the applicable threshold.

In the illustrated embodiment, the cooling refrigerant pump 26 and the heating refrigerant pump 36 are configured to operate based on head pressure, such as discharge pressure or differential pressure. As the control valves 28, 38 for the various coils are opened and closed, the pumps automatically respond as a function of head pressure to supply the appropriate coolant flow rate. In alternative embodiments, flow rates may be actively managed by the control system 40, for example, by increasing or decreasing the pump flow rates depending on the number of active coil sets. In the illustrated embodiment, the flow rate of the cooling refrigerant pump 26 is selected to deliver the desired volume of cooled refrigerant to each active cooling coil 16 and the flow rate of the heating refrigerant pump 36 is selected to deliver the desired volume of heated refrigerant to each of active heating coils 18. In one exemplary embodiment, the present invention is incorporating into a dehumidification system 10 in which each coil set includes a single 5-ton cooling coil 16 and a single 5-ton heating coil 18. In other embodiments, each coil set includes a single 10-ton cooling coil and a single 10-ton heating coil. It should be understood that these coil sizes are merely exemplary and that the coil sizes may vary from application to application as desired. Further, in some applications, the cooling coil 16 and the heating coil 18 may be of different sizes. In the example of a 5-ton coil set, a single cooling coil 16 may be designed to provide optimized performance at 12.1 gallons per minute ("GPM") and the pump for the cooling refrigerant circuit may be configured to operate at a flow rate of about 12.1 GPM times the number of active cooling coils 16. For a 10-ton coil set designed to provide optimize performance at 15 GPM, the flow rate of the pump may be about 15 GPM times the number of active cooling coils 16. Similarly, in applications in which a single 5-ton heating coil 18 is designed to provide optimized performance at 7.4 GPM, the heating refrigerant pump 36 may be configured to operate at a flow rate of about 7.4 GPM times the number of active heating coils 16. For a 10-ton heating coil 18 designed to provide optimize performance at 15 GPM, the flow rate may be about 15 GPM times the number of active heating coils.

In the illustrated embodiment, the control system 40 may also be configured to control the temperature of the cooled refrigerant by controlling operation of the chiller 24 and the temperature of the heated refrigerant by controlling operation of the heater 34. In the example of a 5-ton coil set, the cooled refrigerant is supplied to the cooling coil at a temperature about 25° F. below the dew point of the air being dehumidified, and the flow rate of the cooling refrigerant is selected to provide an approximately 10° F. temperature rise in the cooling refrigerant as it flows through the cooling coil 16. This results in a temperature drop of about 32° F. between the air entering the cooling coil 16 and the air leaving the cooling coil 16. It should be understood that the cooled refrigerant temperature and the planned temperature rise may vary from application to application. For example, the temperature of the cooled refrigerant may be in the range of 20° F. to 30° F. below the dew point of the air being dehumidified, and the planned temperature rise may be in the range of 5° F. to 15° F. In the illustrated embodiment, the heated refrigerant is supplied to the heating coil 18 at a temperature of about 100° F. and the flow rate of the heating refrigerant is selected to provide an approximately 10° F. temperature drop in the heating refrigerant as it flows through the heating coil 18. This results in a temperature rise of about 32° F. between the air entering the heating coil 18 and air leaving the heating coil 18, thereby returning the air leaving the dehumidifier unit 14 to about the same temperature at which it entered the dehumidifier unit 14.

In the illustrated embodiment, the control system 40 may also provide automated control of the blowers 60 in the modular dehumidifier units 14 to control the flow rate of air over the coil set in each unit 14. For example, the control system 40 may shut off the blower 60 in each deactivated modular dehumidifier unit 14, or it may increase or decrease the blower speed to vary the air flow rate through a unit 14 to achieve the most effective CFM. In the example 5-ton coil set, the blower 60 is operated at an initial speed selected to provide an air flow rate of about 1000 cubic feet per minute ("CFM") over the cooling coil 16 and the heating coil 18. In the example 10-ton coil set, the blower 60 is operated at an initial speed selected to provide an air flow rate of about 2100 CFM over the cooling coil 16 and the heating coil 18.

Environmentally Controlled Rooms.

Figure 4:
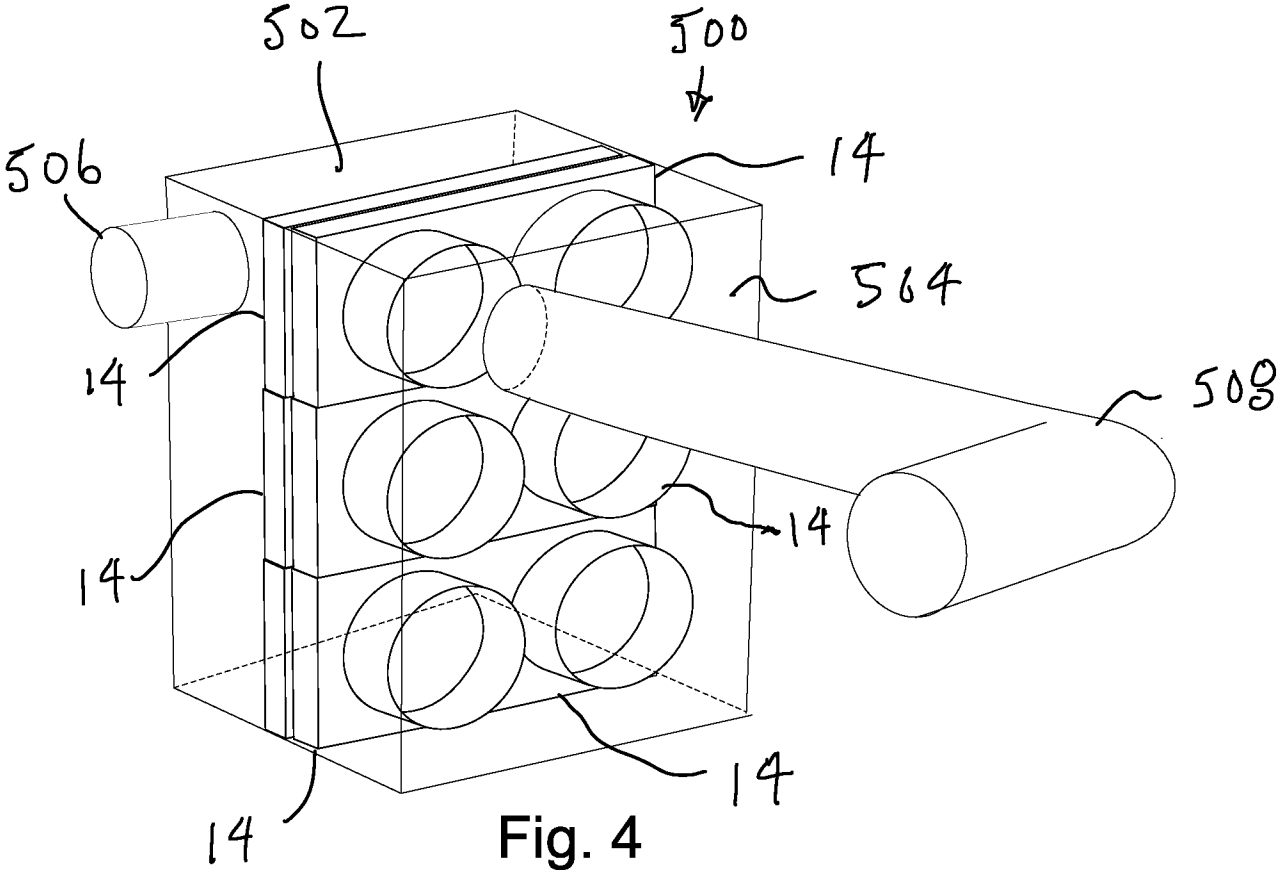
FIG. 4 is an illustration showing a plurality of modular dehumidifier units disposed in a stacked arrangement within an air unit in accordance with an embodiment of the invention.

The dehumidification system 10 may be incorporated into a wide range of environmentally controlled rooms. The design and configuration of the dehumidification system 10 may vary, for example, depending on the size of the environmentally controlled room, the volume and type of organic material, the type of drying processes to be implemented. In some applications, the modular dehumidifier units 14 may be disposed within ductwork or another form of enclosure that is disposed inside or outside the room. For example, FIG. 4 shows a plurality of modular dehumidifier units 14 disposed in an air unit 500. In this embodiment, six modular dehumidifier units 14 are arranged in two side-by-side stacks of three dehumidifier units 14. The dehumidifier units 14 are disposed within the air unit 500 and are configured to separate the interior of the air unit 500 into an inlet portion 502 and an outlet portion 504. The periphery of the dehumidifier units 14 may be sealed or otherwise closed off against the surrounding air unit 500 so that air moving through the air unit 500 is forced to pass from the inlet portion 502 through the operating dehumidifier units 14 to the outlet portion 504. The head unit 12 is not shown in FIG. 4, however, the head unit 12 may be disposed within the air unit 500 or outside the air unit 500, as desired. For example, the head unit 12 may be disposed in a central facilities area within the building containing the environmentally controlled room or it may be disposed outside the building. The air unit 500 includes an inlet duct 506 that provides an air flow passage from the room to the interior of the air unit 500 and an outlet duct 508 for returning air from the air unit 500 to the room. Inside the environmentally controlled room (not shown), additional ductwork or other air distribution components may be provided to set the room air ducts at the desired location and height, and to provide the desired air distribution profile. For example, inside the room, the outlet duct 508 may be fitted with an air distribution sock (not shown) or other ductwork or air distribution components. FIG. 4 represents just one example of how the dehumidifier units 14 of a dehumidification system 10 may be incorporated into an air unit. The air unit 500 may be utilized with essentially any type of environmentally controlled room, such as environmentally controlled room 200 described below or drying tunnel 300 described below. The air unit 500 may be located inside or outside the containment room, as desired for each particular application.

In the illustrated embodiment, the air unit 500 is configured to recirculate air from within the environmentally controlled room. In alternative applications, the dehumidification system 10 may be configured to introduce fresh air into the room. For example, the dehumidification system 10 may draw air in from the environment, such as the outdoors, treat the air and then move it into the environmentally controlled room. The environmentally controlled room may include a pressure exhaust system that allows the room air to exhaust when pressure within the room exceeds a predetermined threshold. In other applications, the control system may be configured to introduce fresh air or recirculate existing room air depending on which approach will be more efficient at any given time. For example, the control system may monitor the temperature and humidity of environmental air and the temperature and humidity of room air, and introduce fresh air from the environment when it is determined that fresh air is closer to the desired set points than air contained within the room.

In alternative embodiments, air filtration and/or other air treatment components can be incorporated into the air unit 500 or into the ductwork upstream and/or downstream from the modular dehumidifier units 14. Essentially any type of air filtering or air cleaning components can be incorporated into the system to clean and ultra clean environments that require efficient moisture removal capabilities without the cost of desiccant type units. For example, the system can be provided with pre-filters, particulate filters, HEPA filters, activated carbon filters and/or UV lights to provide air filtration/cleaning.

Figure 5:
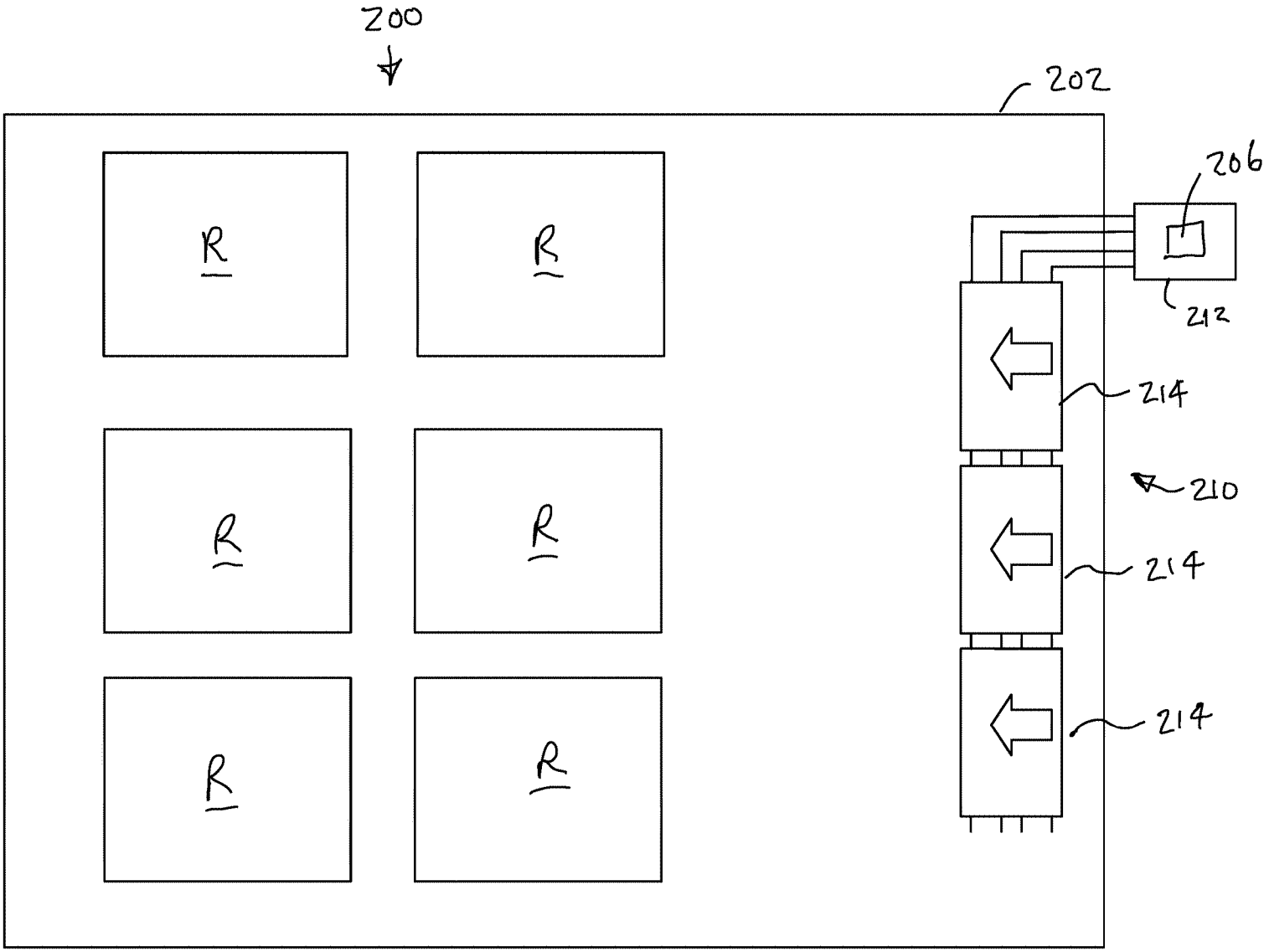
FIG. 5 is a schematic diagram of a first drying room incorporating a drying system in accordance with an embodiment of the invention.

FIG. 5 shows an alternative dehumidification system 210 incorporated into an environmentally controlled room 200 in which plant matter or other agricultural products are stored, for example, on racks, hangers or in bins R. Referring now to FIG. 5, the environmentally controlled room 200 includes a modular dehumidification system 210 in accordance with an embodiment of the present invention. The system 210 includes a head unit 212 located outside the room 200 and three modular dehumidifier units 214 located within the room 200. Although the head unit 212 is shown outside the room 200, it is possible for the head unit 212 to be located inside the room 200 in alternative embodiments. Locating the head unit 212 outside the room 200 may conserve space within the room 200, provide easy access to the head unit 212 without the need to disturb the room 200 and/or prevent heat generated by the head unit 212 from impacting room temperature. In multi-room applications, the head unit 212 may be located in a central location with refrigerant and wiring circuit running to each room 200 containing modular dehumidifier units 214. The environmentally controlled room 200 includes an enclosure 202 that is suitable for the storage of agricultural products, for example hemp cultivars. The environmentally controlled room 200 includes a door to create a hermetic seal. In addition to the dehumidification system 210, the environmentally controlled room 200 may also include a separate atmosphere control system (not shown) adapted to control the atmosphere within the enclosure 202. The separate atmosphere control system may be computer-controlled and may include, for example, the control system disclosed in U.S. Pat. No. 10,143,210 to Schaefer et al., the contents of which are incorporated by reference in their entirety. In the illustrated embodiment, the control system 206 for the dehumidification system 210 is adapted to regulate the humidity and the temperature within the enclosure based on the output of a humidity sensor and a temperature sensor. In operation, the control system 206 functions to regulate the environmentally controlled within the enclosure 202, e.g. to prevent plant infections such as *Botrytis* and *Penicillium* bud rot, in the organic commodities 212 stored therein. To do so, the control system 206 operates the dehumidification system 210 to ensure humidity and temperature values are within a predetermined acceptable range, which are specific to the commodities stored within the enclosure 202, optionally in accordance with a proportional-integral-derivative control loop (as described above). For example, the control system 206 can open control valves 28, 38 for the various dehumidifier units 214 when the room humidity is above a predetermined threshold, and thereafter close control valves 28, 38 when the room humidity falls below the predetermined threshold. The control system 206 can also cool and heat the room without dehumidification, as desired. The dehumidification system 210 of the present invention allows for multiple dehumidifier units to be connected in parallel while maintaining the ability for individual coil control. The modular units 214 can be pre-assembled with the ability for field installation to an existing dehumidifier rack.

Figure 6:
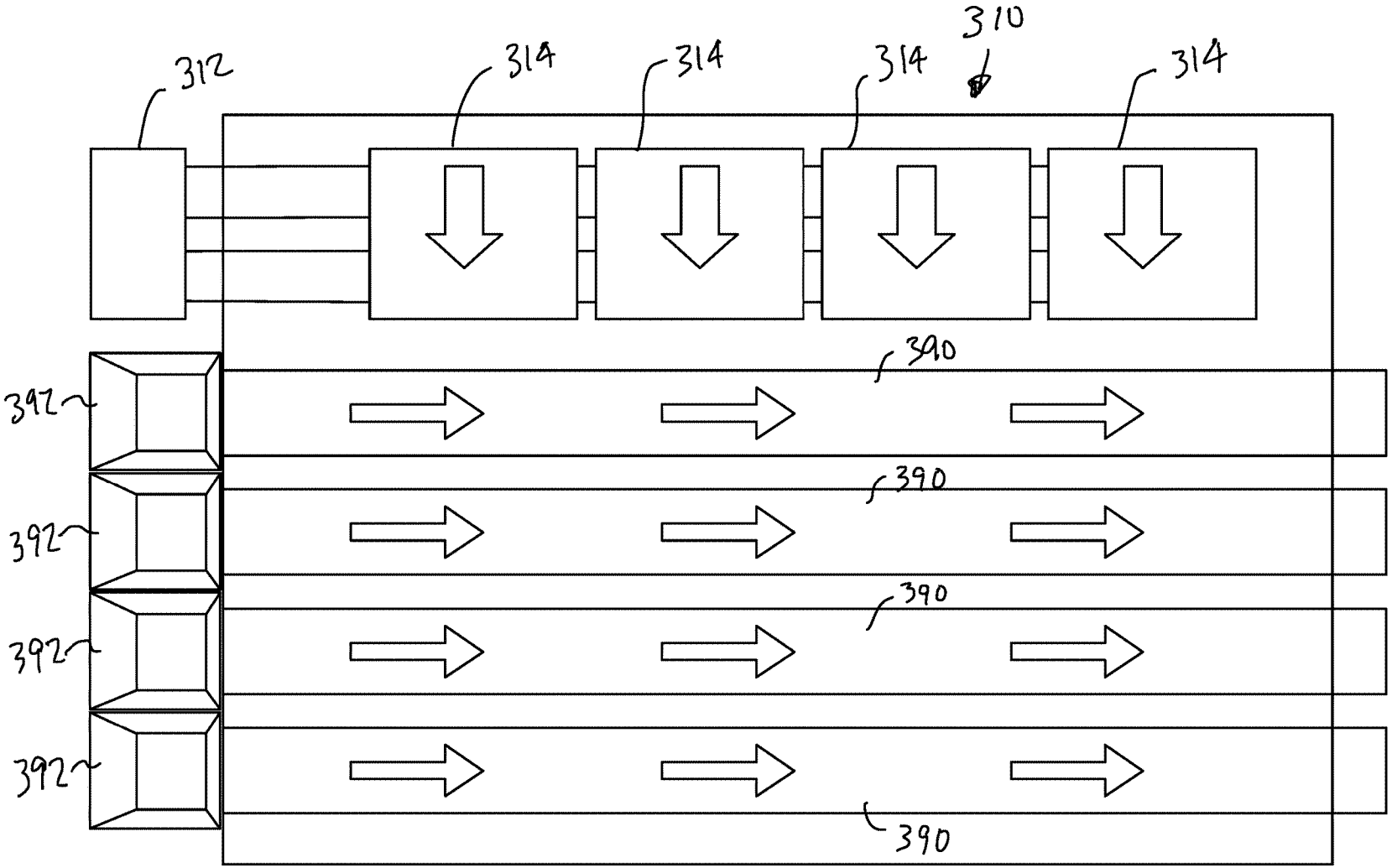
FIG. 6 is a schematic diagram of a second drying room incorporating a drying system in accordance with an embodiment of the invention.

As another example, FIG. 6 shows a dehumidification system incorporated into an environmentally controlled room 300 in the form of a drying tunnel in which harvested plant matter is moved through the drying tunnel on slow moving conveyors. In the embodiment of FIG. 6, the dehumidification system 310 includes a head unit 312 with four modular humidifier units 314 that dehumidify air and move it across an arrangement of four conveyors 390. Each conveyor 390 may include a hopper 392 into which harvested plant matter may be loaded. The conveyors 390 are set to move the harvested plant matter through the drying tunnel at the desired speed, and may be designed to move the plant matter from the room 300 afterward. In the embodiment of FIG. 6, the dehumidification system 310 may be generally disposed along one side of the conveyors 390 with the outlet of the dehumidifier units 314 being directed toward the conveyors 390 the desired pattern. For example, the dehumidifier units 314 may be evenly spaced along the conveyors to provide generally uniform distribution of conditioned air over the commodities carried on the conveyors. In alternative embodiments, modular dehumidifier units 314 may be disposed along opposite sides of the drying tunnel and may be configured to uniformly direct conditioned air inwardly over the conveyors from opposite sides. In alternative embodiments, the drying tunnel may include ductwork or other air distribution components that help to control the distribution of conditioned air over the conveyors. For example, the dehumidifier units 314 may discharge conditioned air into ductwork that contains an arrangement of evenly spaced air outlets that direct the conditioned air evenly over the conveyors.

Although the illustrated embodiments each show a head unit 12, 212, 312 controlling a plurality of dehumidifier units 14, 214, 314 located in a single room, the present invention may be implemented in a system in which a single head unit 12, 212, 312 controls operation of a plurality of modular dehumidifier units 14, 214, 314 disposed in different environmentally controlled rooms. For example, a single head unit may be responsible for supplying cooled and heated refrigerant to a plurality of modular dehumidifier units arranged in parallel with one another and located in essentially any number of separate rooms. The control system may be configured with separate set points for each room. In operation, the control system may separately monitor real-time conditions within each room, compare them with the corresponding set points and modulate the cooling coil and heating coil control valves in each room to move that room to the desired set points, for example, in accordance with the control system discussed above.

Preparing Agricultural Products.

As described in varying levels of detail above, the systems of this disclosure (e.g. the dehumidification systems 10, 210, 310) and the components thereof (e.g. the modular dehumidifier units 14, 214, 314) are widely applicable and may be utilized to store and/or prepare a wide variety of agricultural products, such as plants, plant products, foodstuffs, etc. As such, an illustrative and representative method of preparing an agricultural product is provided (the "preparation method") herein. The preparation method includes disposing an agricultural feedstock in an enclosure equipped with the modular dehumidification system described herein, and exposing the agricultural feedstock to a controlled humidity environment within the enclosure for a period of time, thereby preparing the agricultural product. In some exemplary embodiments, the enclosure 202 of the environmentally controlled room 200 is utilized. In other exemplary embodiments, the environmentally controlled room 300 is utilized in the preparation method, such that the enclosure is the drying tunnel described above.

The controlled humidity environment utilized in the preparation method will generally include preselected atmospheric, conditions, including temperature and humidity level (e.g. #RH), and optionally pressure, light exposure, and various gas concentrations (e.g. oxygen, carbon dioxide, and/or nitrogen levels, etc.), with each condition being independently selected in view of the particular agricultural feedstock being utilized, agricultural product being prepared, etc. As such, while particular examples of the preparation method are provided herein with respect to but a few agricultural feedstocks and products, it is to be appreciated that the environmentally controlled rooms 200, 300 and the dehumidification systems 10, 210, 310 may be utilized other applications, in other preparations, and/or with other atmospheric conditions, e.g. for processing other feedstock and/or preparing other agricultural products.

With regard to the preparation method, the agricultural feedstock is not limited, and may comprise, alternatively may be, a plant (e.g. a seed plant, flowering plant, etc.), a plant material (e.g. a harvested plant material, processed plant material, etc.) or an animal material or product (e.g. meat, cheese, milk, whey, etc.). In one embodiment, the agricultural feedstock is a plant or plant material, and the preparation method is further defined as a method of preparing a plant product therefrom. In this embodiment, the plant or plant material may be exposed to the controlled humidity environment (e.g. via close proximity) during any or all phases of growth of (e.g. cultivation, harvest, and post-harvest processing). Likewise, the preparation method may comprise exposing the plant or plant material to the controlled humidity environment in a live immature form (e.g. in the form of a seed, seedling, cutting, etc.), a live mature form, a freshly-harvested form, a post-harvest partially-processed form, or any combination thereof.

The preparation method may include germinating, growing, harvesting, drying, curing, and/or processing the plant in the controlled humidity environment. Likewise, the plant product prepared via the preparation method may be a live plant, a harvested plant, or a processed form thereof. Accordingly, in one embodiment, the preparation method is further defined as a method of cultivating a plant, where the agricultural feedstock is a live plant in an immature form, and the agricultural product is a mature form thereof. In one embodiment, the preparation method is further defined as a method of processing a plant material, where the agricultural feedstock is a harvested plant or material prepared therefrom (e.g. via cutting, sifting, sorting, washing, etc.), and the agricultural product is a processed from (e.g. a cured, dried, and/or dehydrated) (i.e., a plant product). It will be appreciated that the growth phase of the plant will influence the operations of the dehumidification system 10, 210, 310 employed in the preparation method.

Any plant, or corresponding plant material, may be utilized in the preparation method. In one embodiment, a flowering plant, or material obtained from a flowering plant, is utilized as the agricultural feedstock. Flowering plants suitable for use in this embodiment are not particularly limited and may include, for example, plants of the genus *Cannabis*, including species of *Cannabis sativa, Cannabis indica*, and *Cannabis ruderalis*, as well as derivatives, variants, and combinations thereof. Other flowering plants may also be utilized, such as those from which one or more secondary metabolites may be extracted, as described in further detail below. Examples of suitable plant materials generally include stalks, leaves, stems, seeds, cuttings, fruits, roots, etc. For example, sliced fruit (i.e., the agricultural feedstock) may be utilized in the preparation method to prepare dehydrated fruit pieces (i.e., the agricultural product).

As will be appreciated from the description herein, depending on the materials, equipment, and parameters employed, the preparation method provides for numerous advantageous over conventional plant growing/cultivation methods, with the dehumidification system 10, 200, 300 providing advanced environmental control for increased plant vigor, reduced plant infection/spoliation, increased/improved crop yield (e.g. by biomass), increased growth rates, improved pest control and/or reduced pesticide requirements, and reduced nutrient requirements. Likewise, the preparation method may also provide numerous advantageous over conventional processing methods (e.g. post-harvest processing methods), including faster drying times, more efficient/homogenous drying, reduced spoliation, reduced cure times, improved curing, etc. Moreover, the preparation method may be utilized in both cultivation and processing (e.g. post-harvest) a plant to prepare one or more products therefrom, and thus further provides for increased efficiency and decreased labor, energy, and storage needs over conventional pre- and post-harvesting production methods.

For example, the method of cultivating the plant may be carried out in the enclosure 202 of the environmentally controlled room 200, i.e., using the using the dehumidification system 210. In such instances, the controlled humidity environment will be configured based on the growth needs and characteristics of the plant selected, e.g. to provide optimal growth conditions, or even to provide stressful growth conditions to influence the metabolism of the plant. As another example, the method of processing a plant material may be carried out with the drying tunnel 300, i.e., using the dehumidification system 310, in which instances the controlled humidity environment may be configured to dry the plant material. In such instances, the controllability and variability of the dehumidification system 310 may be used to selectively alter the controlled humidity environment during operation to dry the plant material at a controlled rate, below a temperature set point, etc., thereby allowing for a controlled drying process that may provide increased yields, increased product quality, etc.

The controlled humidity environment is typically configured based on the particular agricultural feedstock being utilized and the desired agricultural product being prepared. For example, in embodiments where the agricultural product is a live plant, such as a flowering plant of genus *Cannabis*, the controlled humidity environment typically comprises a relative humidity of from 40 to 80%, such as from 50 to 80, alternatively from 60 to 80, alternatively from 65 to 75%. Likewise, in such embodiments, the controlled humidity environment typically comprises a temperature of from 10 to 30° C., such as from 12 to 30, alternatively from 12 to 25, alternatively from 15 to 25, alternatively from 15 to 22° C. However, as the environmentally controlled room 200 is configured to dynamically monitor and control the various conditions within the enclosure 202 to establish and maintain the controlled humidity environment, the values and ranges above may describe target values/set points or average values, and not absolute values during the duration of plant exposure.

The period of time during which the agricultural feedstock is exposed to the controlled humidity environment (i.e., the "treatment period") is not particularly limited, and will be independently selected, based on the particular agricultural feedstock being utilized and the desired agricultural product being prepared. In the embodiments above utilizing a plant or plant material as the agricultural feedstock, the time period may be selected in view of the type of plant, growth phase of the plant, a desired growth sequence to be carried out during the exposure, a desired processing step being carried out (e.g. drying, curing, etc.), and the like, as well as combinations thereof. For example, the flowering plant feedstock may be exposed to the controlled humidity environment for a treatment period of at least 24, alternatively at least 48, alternatively at least 72 hours. However, longer treatment periods may also be utilized, such as a period of from 5 days to 6 months, alternatively from 1 week to 3 months, alternatively from 10 days to 3 months, alternatively from 2 weeks to 2 months. In one embodiment, the treatment period includes a growth phase of the plant, alternatively substantially all of a growth phase of the plant, alternatively most of a growth phase of the plant.

In one embodiment, the controlled humidity environment is implemented in two or more sets of conditions, such as a day condition set and a night condition set, which may be alternatingly cycled, i.e., to simulate day and night. For example, the controlled humidity environment may include a day period (e.g. a period of light exposure, i.e., exposure to a light condition) of from 6 to 18 hours, such as from 8 to 16, alternatively from 8 to 14, alternatively from 8 to 12, alternatively from 10 to 12 consecutive hours in each 24 hour period, during which time the day condition set is implemented. In the remaining hours in the 24 hour period, the night condition set is implemented, e.g. exposing the plant to a no-light condition). For example, the day conditions may include constant or near constant light exposure and a temperature of from 12 to 30° C., such as from 22 to 24° C., and the night conditions may include no light exposure and a temperature of from 10 to 26° C., such as from 16 to 20° C. Additional condition sets corresponding to particular growth/processing phases of the flowering plant may also be utilized. In particular, as will be understood by those of skill in the art, the relative humidity values described above with respect to the use of a live flowering plant (e.g. of genus *Cannabis*) are typically utilized in a growth phase of the flowering plant, whereas a drying and/or curing processing phase will include minimal humidity as water is being removed from the flowering plant.

As introduced above, the plant product prepared by the preparation method may be a live flowering plant or a post-harvest product prepared from such a flowering plant. For example, in one embodiment, the preparation method comprises disposing a flowering plant seedling in the enclosure 202 of the environmentally controlled room 200, and exposing the seedling to the controlled humidity environment during a growth phase to provide a live flowering plant as the agricultural product. In another embodiment, a harvested plant material is dried with the drying tunnel 300 as described above. In yet another embodiment, a harvested flowering plant is disposed in the enclosure 202 and exposed to the controlled humidity environment during a curing phase to provide a cured plant product as the agricultural product. With respect to the preceding embodiment, it will be understood by those of skill in the art that the preparation method may be utilized to prepare a cured plant product having an increased content of one or more secondary metabolites compared to a substantially similar plant product not exposed to the controlled humidity environment. For example, exposing the harvested flowering plant to the controlled humidity environment allows for selective removal of water/moisture from the plant material (i.e., dehydration). At certain rates, depending on the plant utilized, the dehydration process may stimulate, upregulate, or otherwise increase the bioproduction of a secondary metabolite by the flowering plant, and/or suppress, downregulate, or otherwise decrease the bioproduction of other compounds within the plant to increase the relative proportion of the secondary metabolite. Examples of such secondary metabolites generally include terpenes and terpenoids, phenolics, glycosides, alkaloids, polyketides, flavonoids, as well as hybrids thereof. For example, in embodiments where a flowering plant the genus *Cannabis* (i.e., a "*Cannabis* plant") is utilized, the preparation method may include increasing the bioproduction of a phytocannabinoid, such as cannabidiol (CBD), tetrahydrocannabinol (THC), cannabinol (CBN), tetrahydrocannabinolic acid (THCA), cannabidiolic acid (CBDA), cannabigerol (CBG), cannabichromene (CBC), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM), cannabielsoin (CBE), cannabicitran (CBT), or combinations thereof. In a similar fashion, it will be appreciated that exposing the harvested flowering plant to the controlled humidity environment of the drying tunnel also allows for selective removal of water/moisture from the plant material (i.e., dehydration). In such instances, the drying process may be configured to dry or dehydrate the plant material without decreasing the content of one or more secondary metabolites therein. For example, the drying tunnel may be operated to dry harvested cannabis material at a temperature selected to minimize loss of one or more of the phytocannabinoids introduced above.

As introduced above, the preparation method is not limited to growing/processing/storing plant and plant products, but may instead be implemented with a wide variety of feedstocks for numerous applications. For example, in one embodiment, the agricultural feedstock is an animal material or product, and the preparation method is further defined as a method of preparing a processed animal product. The animal material is not limited, and is exemplified by meats, cheeses, whey, etc. In one embodiment, the preparation method is further defined as a method of curing meat or cheese, where the agricultural feedstock is selected from meats and cheeses, the controlled humidity environment is configured to cure the meats and/or cheese over the period of time without decomposition and/or spoliation, and the agricultural product is a cured meat or cheese.

In another embodiment, the preparation method is further defined as a method of preparing a whey protein powder. As will be understood by those of skill in the art, whey is a liquid obtained by straining curdled milk, i.e., the liquid, aqueous soluble-protein fraction of acidified milk separated from the coagulated proteins (curds) formed during the curdling/coagulation process. Whey typically comprises various proteins and other biomolecules such as various carbohydrates (e.g. lactose), lipids, etc. However, the composition may be altered during the curdling process (e.g. by selecting particular acids to initiate coagulation, varying the pH during coagulation, etc.) as well as after separation from the curds by various purification methods such as filtration, precipitation, etc. The particular whey suitable for use in the preparation method as the agricultural feedstock is not particularly limited, and may be any whey composition comprising whey proteins, such as a raw unprocessed whey filtrate (e.g. directly post-curd removal), or a processed whey solution. In this embodiment, the controlled humidity environment is configured to dry the whey to prepare a solid containing whey proteins, which may be in the form of a powder or otherwise processed into such a form (e.g. via pulverization, etc.). The controlled humidity environment may be selected to denature the whey proteins during the drying process or, alternatively, to not denature the whey proteins within the whey during drying. As understood by those of skill in the art, whey proteins may denature upon exposure to elevated temperatures and other conditions for prolonged durations, such as the ~72° C. temperatures and time periods used in conventional pasteurization processes.

Owing to the selective control of the drying conditions achievable with the dehumidification systems 10, 210, such as within the environmentally controlled room 200, the preparation process may be utilized to selectively prepare the whey protein powder with or without denaturing the whey proteins therein.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. The present invention is not limited to only those embodiments that include all of these features or that provide all of the stated benefits, except to the extent otherwise expressly set forth in the issued claims. Any reference to claim elements by ordinal terms, for example "first," "second," and "third," are used for clarity, and are not to be construed as limiting the order in which the claim elements appear. Any reference to claim elements in the singular, for example, using the articles "a," "an," "the" or "said," is not to be construed as limiting the element to the singular.

The invention claimed is:

1. A modular dehumidification system for a drying system for agricultural products in an environmentally controlled room comprising:

a head unit having a cooling refrigerant subcircuit and a heating refrigerant subcircuit, the cooling refrigerant subcircuit including a refrigerant chiller, a cooled refrigerant pump, a main supply line and a main return line, the heating refrigerant subcircuit including a refrigerant heater, a heated refrigerant pump, a main supply line and a main return line;

a first dehumidifier unit having:

a cooling supply extension line, a cooling return extension line and a cooling coil connected between the cooling supply extension line and the cooling return extension line, the cooling return extension line connected to the main supply line of the cooling refrigerant subcircuit and the cooling return extension line connected to the main return line of the cooling refrigerant subcircuit, and a heating supply extension line, a heating return extension line and a heating coil connected between the heating supply extension line and the heating return extension line, the heating supply extension line connected to the main supply line of the heating refrigerant subcircuit and the heating return extension line connected to the main return line of the heating refrigerant subcircuit;

a second dehumidifier unit having:

a cooling supply extension line, a cooling return extension line and a cooling coil connected between the cooling supply extension line and the cooling return extension line, the cooling return extension line of the second dehumidifier unit connected to the cooling return extension line of the first dehumidifier unit and the cooling return extension line of the second dehumidifier unit connected to the cooling return extension line of the first dehumidifier unit, and a heating supply extension line, a heating return extension line and a heating coil connected between the heating supply extension line and the heating return extension line, the heating supply extension line of the second dehumidifier unit connected to the heating supply extension line of the first dehumidifier unit and the heating return extension line of the second dehumidifier unit connected to the heating return extension line of the first dehumidifier unit;

wherein the cooling coil of the first dehumidifier unit and the cooling coil of the second dehumidifier unit are connected to the cooling refrigerant subcircuit in parallel, and the heating coil of the first dehumidifier unit and the heating coil of the second dehumidifier unit are connected to the heating refrigerant subcircuit in parallel; and wherein the first dehumidifier unit and the second dehumidifier unit are arranged in a modular configuration to cooperatively treat a common source of air in a single environmentally controlled room, the first and second dehumidifier units each having an inlet to draw air from an interior of the single environmentally controlled room and an outlet to return air to the single environmentally controlled room; and wherein at least the second dehumidifier unit is configured to be selectively activated and deactivated, such that the modular dehumidification system operates efficiently in treating air from the common source of air within a first capacity range corresponding with a combined capacity of the first dehumidifier unit and the second dehumidifier unit when both the first dehumidifier unit and the second dehumidifier unit are active and within a second reduced capacity range corresponding with a capacity of the first dehumidifier unit when the second dehumidifier unit is deactivated.

2. The system of claim 1 wherein at least one of the first dehumidifier unit and the second dehumidifier unit includes a first control valve that is selectively operable between an open position in which refrigerant is able to flow through the cooling coil and a closed position in which refrigerant is not able to flow through the cooling coil, and a second control valve that is selectively operable between an open position in which refrigerant is able to flow through the heating coil and a closed position in which refrigerant is not able to flow through the heating coil, whereby a capacity of the system can be varied by selectively opening and closing the first control valve and the second control valve.

3. The system of claim 1 wherein the first dehumidifier unit and the second dehumidifier unit both include a first control valve that is selectively operable between an open position in which refrigerant is able to flow through the cooling coil and a closed position in which refrigerant is not able to flow through the cooling coil, and a second control valve that is selectively operable between an open position in which refrigerant is able to flow through the heating coil and a closed position in which refrigerant is not able to flow through the heating coil, whereby a capacity of the system can be varied by selectively opening and closing the first control valve and the second control valve.

4. The system of claim 2 wherein the first dehumidifier unit provides a first air flow path over the cooling coil and the heating coil of the first dehumidifier unit and the second dehumidifier unit provides a second air flow path over the cooling coil and the heating coil of the second dehumidifier unit, the first air flow path being arranged in parallel to the second air flow path.

5. The system of claim 3 wherein the first dehumidifier unit includes a first blower moving air through the first air flow path and the second dehumidifier unit includes a second blower moving air through the second air flow path.

6. The system of claim 5 further including a control system configured to control the flow rate of refrigerant through the cooling refrigerant subcircuit as a function of the number of active cooling coils and the flow rate of refrigerant through the heating refrigerant subcircuit as a function of the number of active heating coils.

7. The system of claim 6 wherein the control system is configured to control the flow rate of refrigerant through the cooling refrigerant subcircuit by adjusting operation of the refrigerant pump of the cooling refrigerant subcircuit; and the control system is configured to control the temperature of the cooled refrigerant by adjusting operation of the chiller.

8. The system of claim 7 wherein the control system is configured to operate the chiller to provide cooled refrigerant about 25 degrees Fahrenheit below the dew point of the air.

9. The system of claim 8 wherein the control system is configured to operate the refrigerant pump of the cooling refrigerant subcircuit so that there is an about 10 degree Fahrenheit difference between the refrigerant supplied to the cooling coil and the refrigerant after passing through the cooling coil.

10. The system of claim 9 wherein the control system is configured to operate the refrigerant pump of the heating refrigerant subcircuit so that there is an about 10 degree Fahrenheit difference between the refrigerant supplied to the heating coil and the refrigerant after passing through the heating coil.

11. The system of claim 10 wherein at least one of the flow rate or the temperature of the heated refrigerant is varied so that a temperature of the air leaving the heating coil is about equal to a temperature of the air arriving at the cooling coil.

12. A modular dehumidification system for a drying system for agricultural products in an environmentally controlled room comprising:

a head unit having a refrigerant chiller to cool a first supply of refrigerant and a cooling pump for circulating the cooled refrigerant along a cooling supply line and a cooling return line, the head unit further including a refrigerant heater to heat a second supply of refrigerant and a heating pump for circulating the heated refrigerant along a heating supply line and a heating return line;

a first dehumidifier unit having:

a cooling coil operatively connected to the cooling supply line and the cooling return line, a heating coil operatively connected to the heating supply line and the heating return line, and an air flow path over the cooling coil and the heating coil; and a second dehumidifier unit having:

a cooling coil operatively connected to the cooling supply line and the cooling return line in parallel with the cooling coil of the first dehumidifier unit, a heating coil operatively connected to the heating supply line and the heating return line in parallel with the cooling coil of the first dehumidifier unit, an air flow path over the cooling coil and the heating coil;

wherein the first dehumidifier unit and the second dehumidifier unit are arranged in a modular configuration to cooperatively treat a common source of air in a single environmentally controlled room, the first and second dehumidifier units each having an inlet to draw air from an interior of the single environmentally controlled room and an outlet to return air to the single environmentally controlled room; and wherein at least one of the first dehumidifier unit and the second dehumidifier unit includes at least one control valve to selectively deactivate the cooling coil and the heating coil of that dehumidifier unit without effecting operation of the cooling coil and the heating coil of the other dehumidifier unit, whereby the capacity setting of the dehumidification system can be varied such that the dehumidification system operates efficiently in treating air from the common source of air within a first capacity range corresponding with a combined capacity of the first dehumidifier unit and the second dehumidifier unit when both the first dehumidifier unit and the second dehumidifier unit are active and within a second reduced capacity range corresponding with a capacity of one of the first dehumidifier unit or the second dehumidifier unit when the first dehumidifier unit or the second dehumidifier unit is deactivated.

13. The system of claim 12 further including a control system for controlling operation based on the capacity setting.

14. The system of claim 13 further including a third dehumidifier unit having:

a cooling coil operatively connected to the cooling supply line and the cooling return line in parallel with the cooling coils of the first dehumidifier unit and the second dehumidifier unit, a heating coil operatively connected to the heating supply line and the heating return line in parallel with the cooling coils of the first dehumidifier unit and the second dehumidifier unit, an air flow path over the cooling coil and the heating coil, and at least one control valve to selectively deactivate the cooling coil and the heating coil of the third dehumidifier unit without effecting operation of the cooling coil and the heating coil of the first dehumidifier unit and the second dehumidifier unit.

15. A modular dehumidification system for a drying system for agricultural products in an environmentally controlled room comprising:

a head unit having a cooling refrigerant subcircuit and a heating refrigerant subcircuit, the cooling refrigerant subcircuit including a refrigerant chiller, a cooled refrigerant pump, a main supply line and a main return line, the heating refrigerant subcircuit including a refrigerant heater, a heated refrigerant pump, a main supply line and a main return line;

a first dehumidifier unit having a cooling coil, a cooling coil control valve, a heating coil, and a heating coil control valve, wherein the cooling coil is connected to the cooling refrigerant subcircuit between the main supply line of the cooling refrigerant subcircuit and the main return line of the cooling refrigerant subcircuit, and the heating coil is connected to the heating refrigerant subcircuit between the main supply line of the heating refrigerant subcircuit and the main return line of the heating refrigerant subcircuit;

a second dehumidifier unit having a cooling coil, a cooling coil control valve, a heating coil and a heating coil control valve, wherein cooling coil of the second dehumidifier unit is connected to the cooling refrigerant subcircuit between the main supply line of the cooling refrigerant subcircuit and the main return line of the cooling refrigerant subcircuit in parallel with the cooling coil of the first dehumidifier unit, and the heating coil of the second dehumidifier unit is connected to the heating refrigerant subcircuit between the main supply line of the heating refrigerant subcircuit and the main return line of the heating refrigerant subcircuit in parallel with the heating coil of the first dehumidifier unit; and wherein the first dehumidifier unit and the second dehumidifier unit are arranged in a modular configuration to cooperatively treat a common source of air in a single environmentally controlled room, the first and second dehumidifier units each having an inlet to draw air from an interior of the single environmentally controlled room and an outlet to return air to the single environmentally controlled room; and a control system configured to vary the efficient capacity range of the dehumidification system in treating air from the common source of air over time by selectively activating or deactivating the cooling coils and the heating coils of the first dehumidifier unit and the second dehumidifier unit, the control system activating and deactivating the cooling coils and the heating coils by opening or closing the corresponding control valves, the control system further configured to control operation of each activated cooling coil and each activated heating coil by modulating the corresponding control valve.

16. The dehumidification system of claim 15 where the first dehumidifier unit further includes a blower for moving air first over the cooling coil of the first dehumidifier unit and then over the heating coil of the first dehumidifier unit.

17. The dehumidification system of claim 16 where the second dehumidifier unit further includes a blower for moving air first over the cooling coil of the second dehumidifier unit and then over the heating coil of the second dehumidifier unit.

18. The dehumidification system of claim 17 wherein the control system is configured to measure room temperature and room humidity, the control system setting the capacity of the dehumidification system as a function of at least one of the difference between the measured room temperature and a room temperature set point and the difference between the measure room relative humidity and a room humidity set point.

19. The dehumidification system of claim 18 wherein the control system is capable of operating the dehumidification system in a dehumidification mode in which the control valve for each active cooling coil is modulated so that air moving over the cooling coil is cooled to a temperature at or below the dew point of the air, thereby dehumidifying the air through condensation.

20. The dehumidification system of claim 19 wherein the control system is capable of modulating the control valve for each active heating coil to return heat energy to the air to at least partially offset the temperature loss caused by the cooling coil when in the dehumidification mode.

21. The dehumidification system of claim 15 wherein the control system is capable of operating an idle mode in which all control valves are closed; a dehumidification mode in which at least one cooling coil control valve is modulated to bring the temperature of the air moving over the cooling at least to the dew point of the air to dehumidify the air by condensation and at least one heating coil control valve is modulated to heat the air moving over the heating coil to compensate for temperature loss caused by the cooling coil; a cooling mode in which at least one cooling coil control valve is modulated to reduce the temperature of the air moving over the cooling to a temperature above the dew point of the air; a heating mode in which at least one heating coil control valve is modulated to raise the temperature of the air moving over the heating coil.

* * * * *